US008407838B2

(12) United States Patent
Nakamura et al.

(10) Patent No.: US 8,407,838 B2
(45) Date of Patent: Apr. 2, 2013

(54) AUTOMATIC FECAL AND URINARY TREATMENT DEVICE

(75) Inventors: Minoru Nakamura, Hiroshima (JP); Kim Yong Ha, Yongin-si (KR); Do Hyun Ok, Suwon-si (KR)

(73) Assignees: Minoru Nakamura, Hiroshima (JP); Sanyo Tech Co., Ltd., Gyeonggi-do (KR)

( * ) Notice: Subject to any disclaimer, the term of this patent is extended or adjusted under 35 U.S.C. 154(b) by 361 days.

(21) Appl. No.: 12/892,510

(22) Filed: Sep. 28, 2010

(65) Prior Publication Data

US 2011/0308017 A1 Dec. 22, 2011

Related U.S. Application Data

(60) Provisional application No. 61/357,284, filed on Jun. 22, 2010.

(51) Int. Cl.
*A61G 7/02* (2006.01)

(52) U.S. Cl. ..... 5/695; 5/605; 5/604

(58) Field of Classification Search ..... 5/604–606, 5/600, 695; 4/300, 420, 443–444, 454–455
See application file for complete search history.

(56) References Cited

U.S. PATENT DOCUMENTS

| | | | | |
|---|---|---|---|---|
| 2,506,183 | A * | 5/1950 | Touchberry | 601/156 |
| 2,598,859 | A | 6/1952 | Thompson | |
| 5,101,519 | A * | 4/1992 | Yamamoto | 4/300 |
| 2009/0193573 | A1 * | 8/2009 | Nakamura et al. | 4/320 |
| 2010/0017964 | A1 | 1/2010 | Kruse | |
| 2010/0313357 | A1 * | 12/2010 | Chang | 5/604 |

FOREIGN PATENT DOCUMENTS

| | | |
|---|---|---|
| EP | 2087876 | 8/2009 |
| JP | 8-322868 | 12/1996 |
| JP | 2006-209168 | 8/2006 |
| WO | WO-2008/039044 | 4/2008 |

* cited by examiner

*Primary Examiner* — Fredrick Conley
(74) *Attorney, Agent, or Firm* — Jordan and Hamburg LLP

(57) ABSTRACT

An automatic fecal and urinary treatment device includes: a mattress which has an approximately rectangular mounting hole formed in an approximately center portion thereof; a pedestal which has an upper surface of a concave arcuate shape and is configured to be fitted into the mounting hole; a support frame body which is mounted on the pedestal and has an outer bottom surface of a convex arcuate shape which conforms with the upper surface of a concave arcuate shape so as to allow the lateral swinging of the support frame body on the pedestal; a buttock placing pad which is mounted on an upper surface of the support frame body and forms a U-shaped cutout space in a center portion thereof; and a fecal and urinary treatment unit which is loosely fitted into the U-shaped cutout space formed in the buttock placing pad and is configured to perform washing of buttocks and private parts and discharging of urine and stools to the outside.

9 Claims, 28 Drawing Sheets

AUTOMATIC FECAL AND URINARY TREATMENT DEVICE

BACKGROUND OF THE INVENTION

1. Field of the Invention

The present invention relates to an automatic fecal and urinary treatment device for use in a supine position whereby a bed-ridden patient and/or an aged person can treat his urine and stools in a supine position without another person's assistance.

2. Description of the Related Art

Various diapers and equipment have been devised in the prior art whereby bed-ridden patients and/or aged people can urinate and defecate and treat the urine and stools in a supine position without any assistance from others. For examples, JP-A-8-322868 (patent document 1) discloses a technique in which a fecal and urinary treatment unit of a substantially L-shape as seen from the side is provided with a stool detection sensor and various nozzles.

Referring to this technique, when the patient urinates and defecates, he mounts his haunches on the fecal and urinary treatment unit while tightly holding an upright portion of the fecal and urinary treatment unit in the crotch of his legs. After defecation, the stools detection sensor formed of a proximity sensor detects the stools and automatically causes washing water to inject through various nozzles, thereby washing not only the private parts, but also the inside of the fecal and urinary treatment unit. The stools are then discharged to the outside through a urine-and-stools suction hose. In this manner, the defecation treatment of the bed-ridden patients can be performed automatically.

JP-A-2006-209168 (patent document 2) discloses an automatic treating device for defecation including a diaper-shaped casing of a substantially L-shape with a box type structure which is elongated in the longitudinal direction, a plurality of sensors for detecting excretory substances, a plurality of nozzles for injecting washing water to the excretory substances in order to perform predetermined washing, and a diaper frame in which various nozzles are installed. The plurality of nozzles contiguously installed on the diaper-shaped casing includes an anal nozzle for washing an anal area, a bidet nozzle for washing private parts, a buttocks nozzle for washing a buttocks area, and a stool nozzle for crushing urine and stools materials and discharging these materials to the outside. Each nozzle is also provided with a function of drying the buttocks and private parts. Each sensor includes a stool detection sensor for detecting discharged stools and a urine detection sensor for detecting discharged urine.

SUMMARY OF THE INVENTION

However, the above-mentioned automatic fecal and urinary treatment device has the following drawbacks. The automatic fecal and urinary treatment device adopts the structure where the diaper-shaped casing is directly mounted on a mattress. Accordingly, when washing water, excretion or the like leaks between the mattress and the diaper-shaped casing, there exists a possibility that leaked water or the like will spread on a back surface of the mattress and wets the mattress. Further, because of the above-mentioned structure, it is extremely cumbersome for a patient to mount the diaper-shaped casing on his crotch. Further, when the patient wears the diaper-shaped casing on his crotch, the diaper-shaped casing cannot snugly fit onto his crotch. Further, when the patient wears the diaper-shaped casing on his crotch while lying on his back, buttocks of the patient outside the diaper-shaped casing are not sufficiently supported and hence, the patient feels pain in his buttocks and his crotch. Although a diaper frame may be additionally attached to the diaper-shaped casing, this makes the structure of the diaper-shaped casing complicated.

In view of such circumstances, the inventor of the present invention developed a technique which can overcome various drawbacks of the conventional automatic fecal and urinary treatment device by mounting a portion of a diaper-shaped casing on a bedding and, at the same time, a portion of the automatic fecal and urinary treatment device which treats urine and stools in a crotch of a patient. To be more specific, the inventor of the present invention proposed the automatic fecal and urinary treatment device in which, as shown in FIG. 41, a fitting hole 1012 is formed in a center portion of a mattress 1011, a support frame body 1031 into which a buttock placing pad 1041 having a U-shaped cutout hole 1042 is fitted is fitted into the fitting hole 1012, and the patient wears an L-shaped fecal and urinary treatment unit 1051 and conducts the urination or defecation, and the urine and stools are discharged to the outside of the fecal and urinary treatment unit 1051 by a predetermined means. Further, a diaper 1021 is interposed between a mattress 1011 and the fecal and urinary treatment unit 1051 so as to cover the crotch of the patient and hence, it is possible to prevent the patient from feeling embarrassment while preventing scattering and leaking of urine and stools and spreading of a foul odor.

However, even in these automatic treating devices for urination and defecation, the crotch of the patient is integrally fixed to the treatment device so as to prevent the patient from moving his hips laterally when the patient urinates or defecates. When the patient attempts to displace his buttocks from a predetermined position, a load is applied to the treatment device so that integral fixing of the treatment device to the patient's crotch is obstructed. Accordingly, there arises such a drawback that urine and stools leak to the outside or a drawback that detection accuracy of various sensors is lowered so that a functional defect occurs whereby a predetermined washing effect cannot be acquired.

The present invention has been made under such circumstances, and it is an object of the present invention to provide an automatic fecal and urinary treatment device in which a fecal and urinary treatment unit which a patient wears on his crotch is fitted into a support frame body, the support frame body is laterally swingably mounted on an upper surface of a pedestal which is mounted on a mattress, wherein even when buttocks of a patient slightly moves, a fecal and urinary treatment unit is also swung in tandem with the movement of the buttocks thus enhancing the integrity of the buttocks with the fecal and urinary treatment unit whereby leaking of urine and stools can be prevented as much as possible, the movement of the buttocks does not obstruct functions of sensors, and feeling of a good fit that the patient has when he wears the automatic fecal and urinary treatment device is improved so that the patient can use the treating device without any pain or discomfort.

It is another object of the present invention to provide an automatic fecal and urinary treatment device which can simplify the entire structure thereof.

(1) According to one aspect of the present invention, there is provided an automatic fecal and urinary treatment device including: a mattress which has an approximately rectangular mounting hole formed in an approximately center portion thereof; a pedestal which has an upper surface of a concave arcuate shape and is configured to be fitted into the mounting hole; a support frame body which is mounted on the pedestal and has an outer bottom surface of a convex arcuate shape which conforms with the upper surface of a concave arcuate shape so as to allow the lateral swinging of the support frame body on the pedestal; a buttock placing pad which is mounted on an upper surface of the support frame body and forms a U-shaped cutout space in a center portion thereof; and a fecal and urinary treatment unit which is loosely fitted into the U-shaped cutout space formed in the buttock placing pad and is configured to perform washing of buttocks and private parts and discharging of urine and stools to the outside.

(2) In the automatic fecal and urinary treatment device having the above-mentioned constitution (1), an adjustment stopper means which restricts a swing range of the support frame body is formed on a distal edge portion of the upper surface of the pedestal having a concave arcuate shape.

(3) In the automatic fecal and urinary treatment device having the above-mentioned constitution (1) or (2), an insertion hole is formed in left and right portions of a front wall of the pedestal, left and right free ends of approximately mountain-shaped fixing jigs are allowed to be inserted into the insertion holes thus preventing the support frame body which is swingably mounted on the pedestal from being removed from the pedestal using a fixing jig when the support frame body is swung.

(4) In the automatic fecal and urinary treatment device having any one of the above-mentioned constitutions (1) to (3), an inner bottom surface of the support frame body is formed into a concave arcuate shape and an outer bottom surface of the buttock placing pad is formed into a convex arcuate shape, and the buttock placing pad is mounted on an upper surface of the support frame body in a close contact state.

(5) In the automatic fecal and urinary treatment device having any one of the above-mentioned constitutions (1) to (4), the fecal and urinary treatment unit has an approximately L shape and is constituted of a horizontal member which has the inside thereof formed into a boat shape and is configured to discharge urine and stools to the outside by making use of discharged water from a nozzle mounted on a bottom portion of the fecal and urinary treatment unit, and a vertical member which mounts a nozzle for drying with supply of air after washing buttocks and private parts on a front surface thereof, a distal end of the horizontal member of the fecal and urinary treatment unit is communicably connected with a storage tank by way of a discharge pipe, and various nozzles which are mounted on the horizontal member and the vertical member are communicably connected with a washing water supply portion by way of a nozzle operation portion which is configured to perform a water supply control and an air supply control.

(6) In the automatic fecal and urinary treatment device having the above-mentioned constitution (1), a detection means which detects a swing angle of the support frame body is mounted on the support frame body which is swingable on the pedestal, and washing of the buttocks and the private parts is stopped when the detection means detects a swing of equal to or more than a fixed angle.

(7) In the automatic fecal and urinary treatment device having the above-mentioned constitution (6), the detection means is a magnetic sensor which detects a swing angle by sensing a magnetic field of a magnet mounted on the pedestal.

(8) In the automatic fecal and urinary treatment device, a pipe passage extending to an end portion of the mattress from the mounting hole is provided, the fecal and urinary treatment unit which is mounted in the mounting hole and a discharge pipe fitted into a pipe passage are communicated with each other, and urine and stools are conveyable to the outside of the mattress by the fecal and urinary treatment unit by way of a discharge pipe, and a bent portion is formed on a portion of a urination and defecation passage ranging from the inside of the fecal and urinary treatment unit to a downstream end of the discharge pipe thus generating a vortex flow at the time of conveying urine and stools.

(9) In the automatic fecal and urinary treatment device having the above-mentioned constitution (1), a diaper for the fecal and urinary treatment unit is mounted on a periphery of the mounting hole, and the diaper is constituted of: a waist wrapping portion which is an approximately triangular large-width upper end portion of the diaper and is stretchable laterally so as to cover hips of a patient; a central hole which is formed in a center portion of the diaper in a state where the hole is aligned with the mounting hole formed in the approximately center portion of the mattress; a fold-over covering portion which extends downward with a width thereof gradually narrowed from the central hole and is foldable toward the waist wrapping portion; and a slide fastener which is formed on an approximately center portion of the fold-over covering portion, is operable to be opened or closed in the lateral direction from the center of the fold-over covering portion, and has an upstream end thereof positioned at the central hole and has a downstream end thereof positioned at an intermediate portion of the fold-over covering portion.

According to the automatic fecal and urinary treatment device having the above-mentioned constitution (1), the automatic treating device is configured such that the support casing is mounted in the mounting hole formed in the mattress, the buttock placing pad is mounted on the support casing, the patient lies on the mattress in a supine state, the fecal and urinary treatment unit having an approximately L shape is loosely fitted into the U-shaped cutout space in the crotch of the patient, and the fecal and urinary treatment unit is mounted in the crotch whereby the automatic treating device can be easily mounted in the crotch of the patient. Accordingly, even when the patient cannot mount the automatic treating device on his body by himself, it is possible to easily mount the automatic treating device on the patient with the assistance of one helper by taking the above-mentioned steps. Further, in removing the fecal and urinary treatment unit from the patient, the buttocks of the patient which project to the outside of the fecal and urinary treatment unit is in contact with the buttock placing pad and hence, the weight of the buttocks of the patient is supported by the buttock placing pad whereby the fecal and urinary treatment unit can be easily separated from the patient by pulling. Further, when the fecal and urinary treatment unit is mounted on the patient in a state where the fecal and urinary treatment unit is clamped in the crotch of the patient, the buttocks which project to the outside of the fecal and urinary treatment unit are supported on the buttock placing pad so that the center of gravity of the patient in the vicinity of his buttocks is stabilized and, at the same time, the crotch of the patient is brought into close contact with the fecal and urinary treatment unit and hence, the patient can enjoy the feeling of a good fit. Further, even when a bed-ridden patient uses the automatic treating device for a long period, the occurrence of a bed sore of the buttocks can be prevented. Further, when washing water leaks from the fecal and urinary treatment unit, leaked water is temporarily stored in the support frame body arranged below the fecal and urinary treatment unit thus eliminating the possibility that the rear surface of the mattress is directly immersed with intrusion water. Particularly, the support frame body is swingable on the pedestal by way of the concave arcuate upper surface and the convex arcuate outer bottom surface and hence, even when a patient's hip portion or a patient's buttock portion is swung or displaced, the support frame body is also swung in tandem with the swing of the hip portion or the buttock portion of the patient so that the support frame body is always integrally moved with the hip portion or the buttock portion of the patient whereby the leaking of urine and stools can be prevented and, at the same time, accurate detection functions of respective sensors are not obstructed by the movement of the patient.

According to the automatic fecal and urinary treatment device having the above-mentioned constitution (2), when the support frame body is swung excessively largely during the treatment of the urination and defecation or during the washing of private parts, urine and stools or treatment water leaks from the inside of the fecal and urinary treatment unit. The adjustment stopper means which is formed on the distal edge of the upper surface of the pedestal having a concave arcuate shape can restrict a swing range of the support frame body and hence, it is possible to normally discharge the urine and stools and treatment water to the outside of the fecal and urinary treatment unit.

According to the automatic fecal and urinary treatment device having the above-mentioned constitution (3), even when a patient inadvertently moves his body during a period in which the patient urinates or defecates, during private parts of the patient are washed or during the patient sleeps, the fixing means restricts the swing operation of the fecal and urinary treatment unit so that it is possible to prevent the removal of the fecal and urinary treatment unit from the pedestal.

According to the automatic fecal and urinary treatment device having the above-mentioned constitution (4), the inner bottom surface of the support frame body is formed into a concave arcuate shape and the outer bottom surface of the buttock placing pad is formed into a convex arcuate shape and hence, the buttock placing pad can be placed on an upper surface of the support frame body in a stable manner. Accordingly, even when a buttock portion or the like of a patient is displaced on the buttock placing pad, the support frame body can absorb the displacement on the pedestal so that it is possible to prevent the buttock placing pad from being displaced independently.

According to the automatic fecal and urinary treatment device having the above-mentioned constitution (5), the fecal and urinary treatment unit is constituted of the horizontal member which has the inside thereof formed into a boat shape and is configured to discharge urine and stools to the outside by making use of discharged water from the nozzle formed on the bottom portion of the fecal and urinary treatment unit, and the vertical member which mounts the nozzle for drying by air supply after washing buttocks and private parts on the front surface thereof. Accordingly, the fecal and urinary treatment unit has the simple structure where the respective nozzles are preliminarily directly mounted on the horizontal member and the vertical member and hence, assembling and disassembling of the horizontal member and the vertical member can be carried out within a short time. Further, the downstream end of the horizontal member of the fecal and urinary treatment unit is communicably connected with the storage tank by way of the discharge pipe, and various nozzles mounted on the horizontal member and the vertical member are communicably connected with the washing water supply portion by way of the nozzle operation portion which is configured to perform a water supply control and an air supply control and hence, it is possible to perform the automatic urination and defecation treatment while controlling the treatment of urination and defecation of a patient in a face-up state and washing and drying treatment of private parts or a buttock portion of the patient by the nozzle operation portion.

According to the automatic fecal and urinary treatment device having the above-mentioned constitution (6), the detection means which detects a swing angle of the support frame body is mounted on the support frame body which is swingable on the pedestal and hence, washing of a buttock portion or private parts can be stopped when swinging of the support frame body at a fixed angle or more is detected whereby leaking of treatment water from the inside of the fecal and urinary treatment unit can be obviated. On the other hand, when the swing angle detected by the detection means is less than the fixed angle, washing of the buttock portion or the private parts can be operated as usual.

According to the automatic fecal and urinary treatment device having the above-mentioned constitution (7), the detection means is a magnetic sensor which detects the swing angle by sensing a magnetic field of the magnet mounted on the pedestal. Due to such a constitution, when the magnetic sensor cannot detect a magnetic field of a magnet due to the large inclining of the support frame body, the detection means can transmit a signal for stopping washing to a treatment operation part so that the treatment operation part can stop washing of a buttock portion or private parts of a patient and washing of urine and stools to be discharged. Accordingly, even when the support frame body is inadvertently swung, leaking of washing water or urine and stools to the outside of the fecal and urinary treatment unit can be prevented as much as possible.

According to the automatic fecal and urinary treatment device having the above-mentioned constitution (8), the bent portion is formed on a portion of the urination and defecation passage ranging from the inside of the fecal and urinary treatment unit to the downstream end of the discharge pipe. Due to such a constitution, at the time of conveying urine and stools discharged in the inside of the fecal and urinary treatment unit and washing water to the outside of the mattress by way of the discharge pipe, the urine and stools and the washing water are stopped at the bent portion of the urination and defecation discharge passage and hence, a space in the urination and defecation passage is hermetically closed or narrowed. When a suction is made in such a state, a negative pressure state arises in the inside of the urination and defecation discharge passage downstream of the portion where the urine and stools and the washing water are stopped. Accordingly, when the urine and stools and the washing water flow in the bent portion of the urination and defecation discharge passage, a centrifugal force is generated in the urine and stools and the washing water at a center position in a tubular cross section of the urination and defecation discharge passage due to a curvature of the bent portion and hence, a first flow which is directed toward an upper portion from a lower portion of the bent portion (or toward the lower portion from the upper portion) is generated. Further, the pressure distribution differs between the upper portion and the lower portion in the bent portion of the urination and defecation discharge passage and a pressure gradient force is generated so that a second flow which is directed toward the lower portion from the upper portion of the bent portion (or toward the upper portion from the lower portion) is generated. A vortex flow is generated due to the first flow and the second flow. The urine and stools and the washing water which contains the vortex flow can be readily discharged from the urination and defecation discharge passage. Further, the accumulation of the urine and stools and the washing water in the urination and defecation discharge passage attributed to the adhesion of urine and stools and the washing water to the urination and defecation discharge passage can be prevented and hence, it is possible to prevent a foul odor generating from the urination and defecation discharge passage thus allowing a patient to use the automatic treating device in a hygienic state.

According to the automatic fecal and urinary treatment device having the above-mentioned constitution (9), the diaper for the fecal and urinary treatment unit is constituted of the waist wrapping portion, the central hole, the fold-over covering portion and a slide fastener. Further, a slide fastener has the downstream end thereof positioned at the central hole and has the upstream end thereof positioned at the intermediate portion of the fold-over covering portion. Accordingly, the diaper can surely cover hips of the patient and, at the same time, the patient can firmly wear the diaper. Particularly, the fold-over covering portion can be folded back so as to cover private parts of the patient. Accordingly, the waist wrapping portion and the fold-over covering portion can completely cover the hips and the private parts of the patient, and the waist wrapping portion and the fold-over covering portion can be surely fixed to the patient so that these parts follow the movement of the hips of the patient thus preventing the removal of the diaper during the use of the automatic treating device. Further, the slide fastener extends to the intermediate portion of the fold-over covering portion from the central hole and hence, it is possible to mount the fecal and urinary treatment unit to be mounted on a crotch of the patient in a state where the diaper for fecal and urinary treatment unit is held mounted on the patient. That is, the fold-over covering portion is opened laterally by opening the slide fastener, the fecal and urinary treatment unit having a predetermined shape is inserted into the inside of the diaper through an opening portion of the slide fastener and is mounted on a crotch of the patient, thereafter, the slide fastener is closed thus bringing about a mounting state where the fecal and urinary treatment unit is accommodated in the fold-over covering portion. Accordingly, it is unnecessary to detach the diaper from the patient each time the fecal and urinary treatment unit is mounted on the patient thus enhancing a treatment operation using the automatic treating device.

DESCRIPTION OF THE PREFERRED EMBODIMENTS

Embodiments of the present invention are explained with reference to the accompanying drawings.

Figure 1:
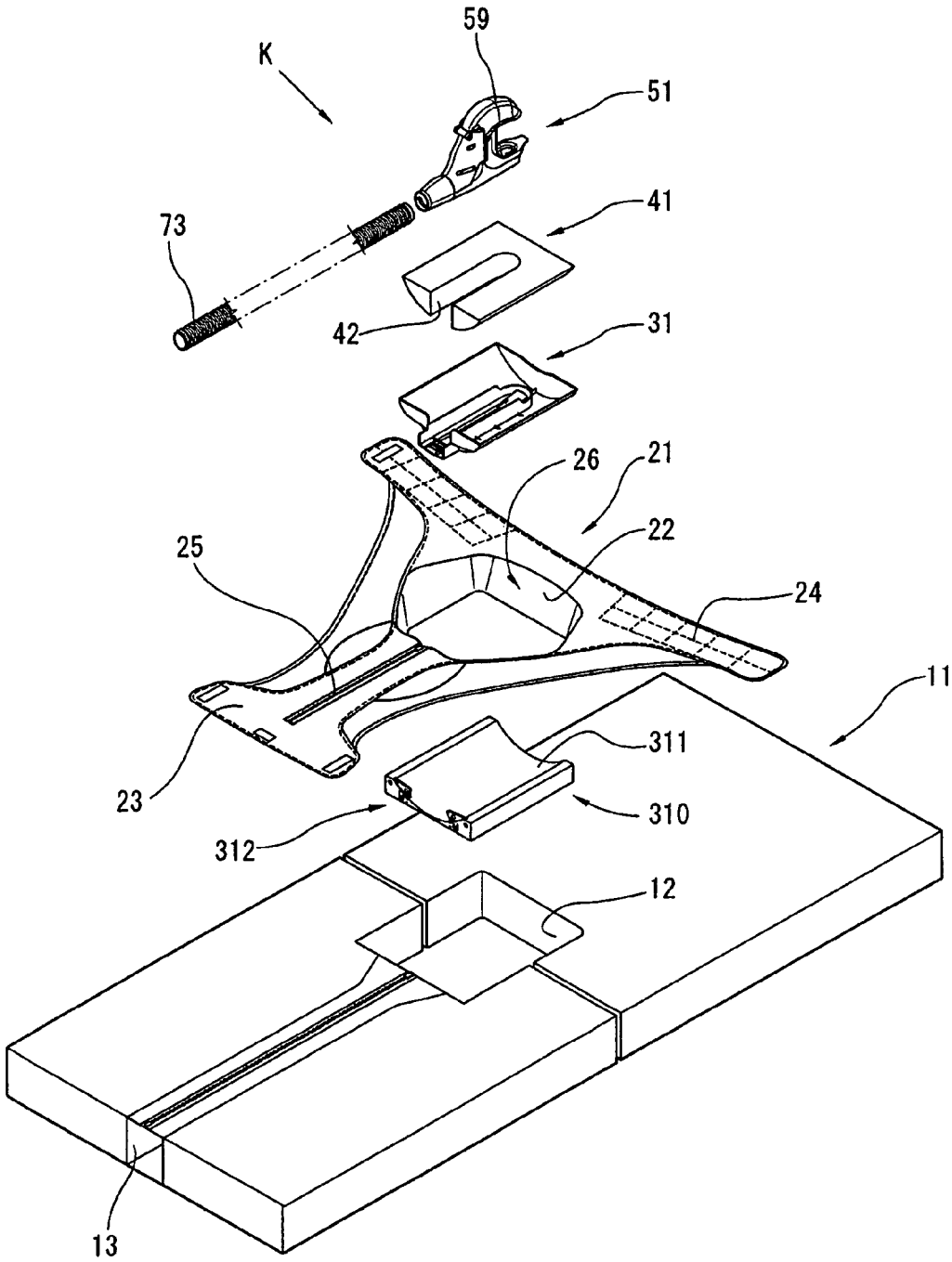
FIG. 1 is an exploded perspective view showing an automatic fecal and urinary treatment device according to this embodiment.

In FIG. 1, symbol K indicates an automatic fecal and urinary treatment device according to an embodiment of the present invention, and the automatic fecal and urinary treatment device K approximately has the following constitution.

That is, a mounting hole 12 is formed in a center portion of an urethane-made mattress 11 which has a sufficient area to allow a patient to lie thereon. One side of the mounting hole 12 is communicated with a pipe passage 13 which is formed in the mattress 11.

The mounting hole 12 has an approximately rectangular shape, and a diaper 21 which forms an opening 22 corresponding to the mounting hole 12 in a center portion thereof is mounted on the periphery of the mounting hole 12. In placing the diaper 21, the hole 22 and the mounting hole 12 are aligned with each other in a state where a fold-over covering portion 23 which constitutes a downstream side of the diaper 21 and a hips surrounding part 24 which constitutes an upstream side of the diaper 21 project from an outer periphery of the mounting hole 12.

Figure 2:
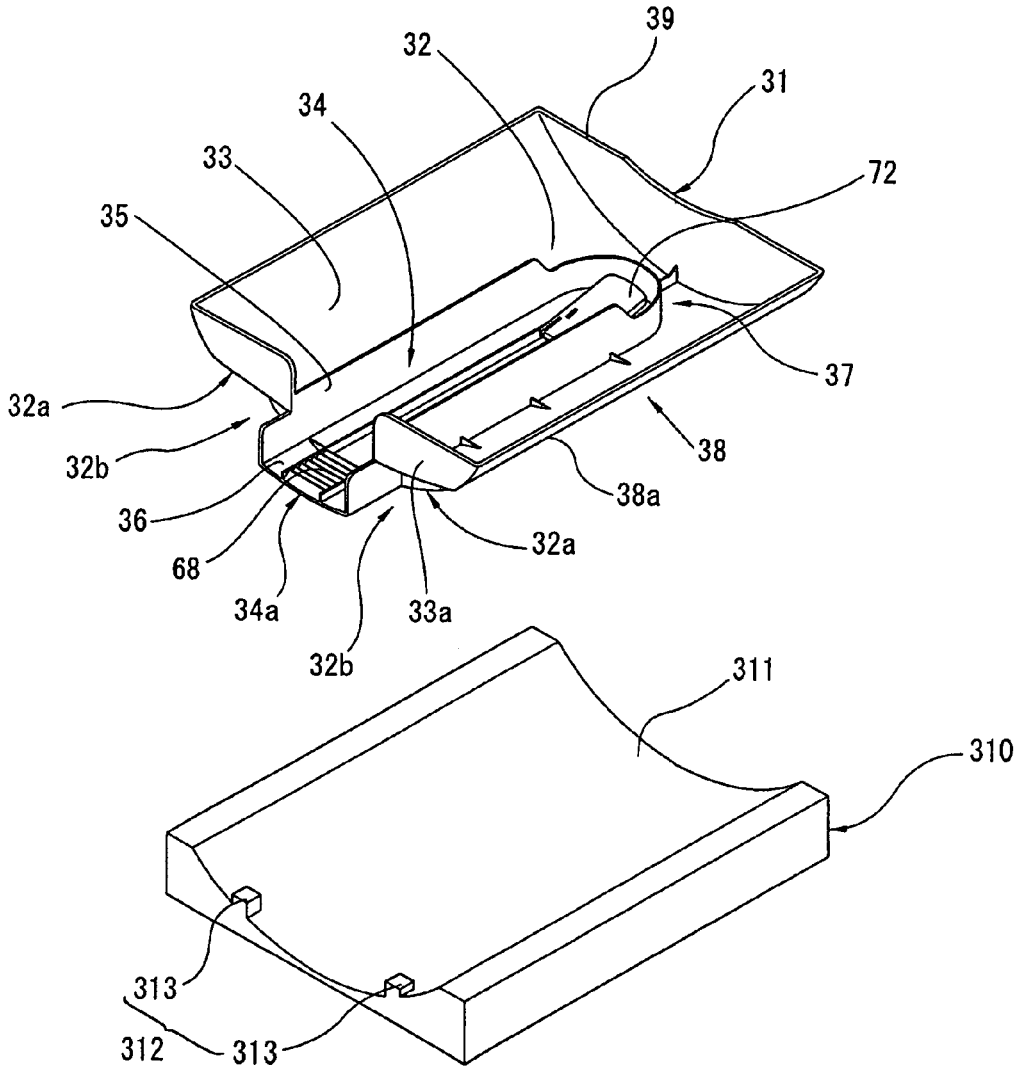
FIG. 2 is an exploded perspective view showing a support frame body and a pedestal of the automatic treating device.

As shown in FIG. 2, a rectangular pedestal 310 is fitted in the mounting hole 12 (see FIG. 1), and a recessed arcuate swing receiving surface 311 having a concave arcuate shape or a concave semicircular shape is formed on an upper surface of the pedestal 310, and an adjustment stopper means 312 which restricts a swing range of a support frame body 31 described later is formed on a distal edge portion of the swing receiving surface 311.

Figure 3:
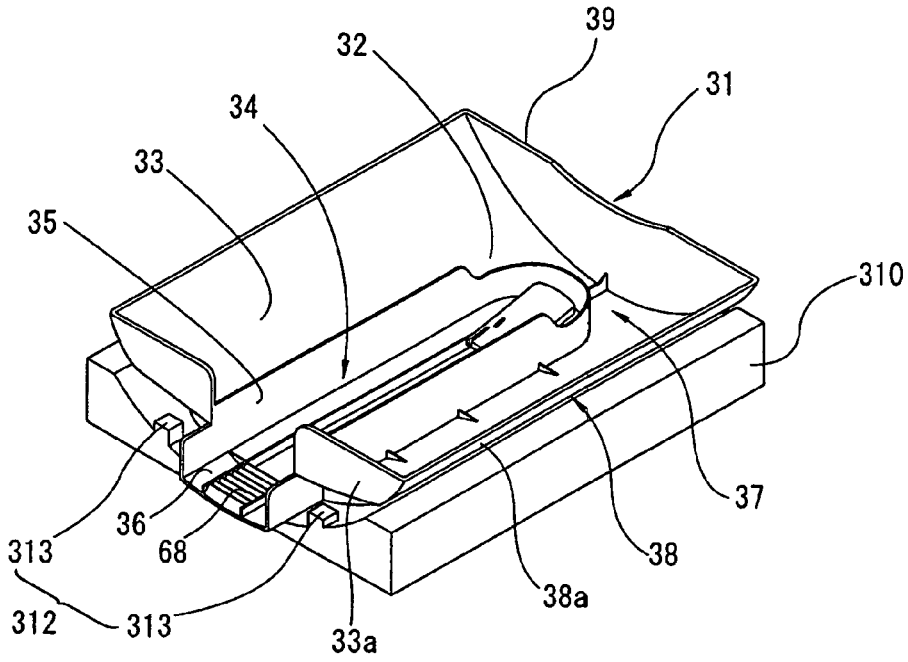
FIG. 3 is a perspective view showing a state where the support frame body is mounted on the pedestal.

Further, as shown in FIG. 2 and FIG. 3, the approximately rectangular support frame body 31 described hereinafter is swingably placed on the pedestal 310. That is, a swing bottom portion 38 having a convex arcuate shape or a convex semicircular shape is formed on an outer bottom surface 38*a* of the support frame body 31 (see FIG. 3). An urethane-made approximately U-shaped buttock placing pad 41 (see FIG. 1) is mounted on the support frame body 31, and a horizontal member 52 (see FIG. 15) of a fecal and urinary treatment unit 51 having an approximately L shape is loosely fitted into a U-shaped cutout space 42 formed in a center portion of the buttock placing pad 41. Accordingly, in a state where the buttock placing pad 41 and the fecal and urinary treatment unit 51 having an approximately L shape are mounted on the support frame body 31, a vertical member 53 (see FIG. 15) of the fecal and urinary treatment unit 51 projects upward from an upper surface of the buttock placing pad 41.

Figure 17:
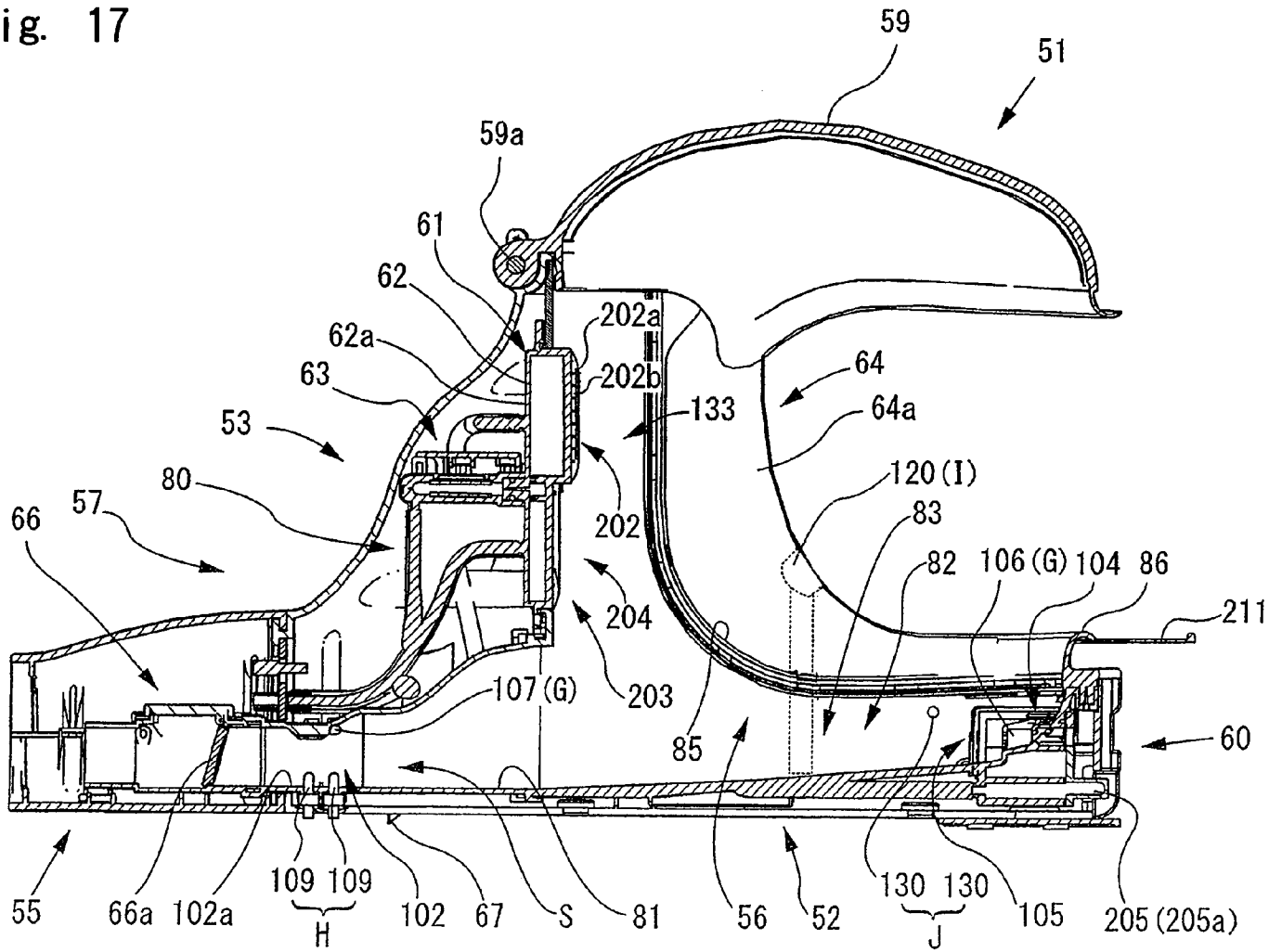
FIG. 17 is a cross-sectional view of the fecal and urinary treatment unit.

In using the automatic fecal and urinary treatment device of this invention K, a user lies on the mattress 11 in a supine posture thus placing his buttocks on the buttock placing pad 41. As shown in FIG. 17, the patient urinates or defecates in the boat-shaped inside of the L-shaped horizontal member 52 in a state where the patient holds the approximately L-shaped vertical member 53 of the fecal and urinary treatment unit 51 in the crotch of his legs. With water which is discharged from a water injection nozzle 105 mounted on a head portion of the horizontal member 52, the urine and stools are discharged to the outside of the fecal and urinary treatment unit 51, while with washing water discharged from a washing nozzle 203 and a bidet nozzle 202 mounted on the vertical member 53 of the fecal and urinary treatment unit 51, buttocks and private parts of the patient are washed. Further, with washing water discharged from a buttock nozzle 104 mounted on the horizontal member 52 of the fecal and urinary treatment unit 51, the buttocks of the patient are washed. Then, the buttocks and the private parts are dried with air supplied from the drying nozzle 204 an air supply nozzle 205.

Next, the respective constitutional parts which constitute the automatic fecal and urinary treatment device K is explained.

(i) The Diaper 21 to be Spread on the Periphery of the Mounting Hole 12 is Explained.

As shown in FIG. 1, in the center portion of the diaper 21, the hole 22 corresponding to the mounting hole 12 formed in the mattress 11 is formed. A rectangular box-shaped bag 26 is mounted on a rear side of the hole 22 in a downwardly extending manner, and the box-shaped bag 26 is fitted into the central mounting hole 12 when the diaper 21 is mounted on the periphery of the mattress 11. The pedestal 310 described later is fitted into the box-shaped bag 26. A portion of the diaper 21 arranged below the hole 22 forms the fold-over covering portion 23 which is provided for covering a laterally exposed crotch of the patient. A portion of the diaper 21 arranged above the hole 22 forms a waist wrapping portion 24 which bulges toward left and right sides.

The diaper 21 is mounted on the mattress 11 in a spreading manner to surround the periphery of the mounting hole 12 of the mattress 11. A cut line is formed at the center of the fold-over covering portion 23 of the diaper 21, and portions of the fold-over covering portion 23 on both left and right sides of the cut line are joined to each other or separated from each other using a slide fastener 25. Another end of the slide fastener 25 is ended in the middle of the fold-over covering portion 23. Accordingly, the fold-over covering portion 23 can be expanded laterally using the slide fastener 25 as the center and hence, when the fecal and urinary treatment unit 51 described later is fitted into the U-shaped cutout space 42 of the approximately U-shaped buttock placing pad 41, the diaper 21 does not obstruct the fitting operation so that it is possible to easily fit the fecal and urinary treatment unit 51 into the U-shaped cutout space 42 through the slide fastener 25 of the diaper 21.

Here, steps for putting the diaper 21 on the patient are explained.

As shown in FIG. 1, the diaper 21 having the hole 22 which corresponds to the mounting hole 12 at the center portion thereof is mounted on the periphery of the mounting hole 12 formed in the mattress 11. Here, the hole 22 and the mounting hole 12 are aligned with each other, the box-shaped bag 26 is fitted into the mounting hole 12, and the fold-over covering portion 23 which constitutes a downstream extending portion of the diaper 21 and the waist wrapping portion 24 which constitutes an upstream extending portion project toward an outer periphery from the mounting hole 12 which constitutes the center of the diaper 21.

Next, the pedestal 310 described later is fitted into the box-shaped bag 26 which is contiguously formed with the hole 22 formed in the diaper 21, the support frame body 31 is mounted on the pedestal 310, the buttock-placing pad 41 is mounted on the support frame body 31 and, thereafter, a helper places buttocks of a patient on the buttock-placing pad 41 thus bringing the patient in a supine state on the mattress 11.

Next, the diaper 21 is laterally opened with respect to the slide fastener 25 formed along the cut line, and the fecal and urinary treatment unit 51 having an approximately L-shape is inserted through the laterally stretched opening portion, and is fitted into the U-shaped cutout space 42 formed in the buttock placing pad 41. At the same time, the patient holds the fecal and urinary treatment unit 51 with his thighs, and private parts of the patient are concealed from above by a cover body 59 mounted on the fecal and urinary treatment unit 51.

Next, the left and right waist wrapping portions 24 of the diaper 21 are wrapped around an abdominal region of the patient in an overlapping manner and tapes of both waist wrapping portions 24 are adhered and fixed to each other. Next, the cover body 59 is covered with the fold-over covering portion 23 of the diaper 21 and, thereafter, the tapes on the end portions of the fold-over covering portion 23 are fixedly mounted on the waist wrapping portions 24 put on the hips of the patient.

(ii) The Pedestal 310 is Explained.

As shown in FIG. 2 and FIG. 3, the pedestal 310 is formed into a rectangular shape having a fixed thickness which allows fitting of the pedestal 310 into the mounting hole 12 formed in the mattress 11 (see FIG. 1). A swing receiving surface 311 having a concave arcuate shape is formed on an upper surface of the pedestal 310. Also on a front edge portion of the swing receiving surface 311, an adjustment stopper means 312 which restricts a swing range of the support frame body 31 swingably placed on the swing receiving surface 311 is formed.

That is, the adjustment stopper means 312 is configured such that projections 313, 313 are formed in a projecting manner on left and right sides of the arcuate surface of the front edge portion of the swing receiving surface 311, and constitutional members of the support frame body 31 described later are brought into contact with the projections 313, 313 so that the excessive lateral swinging of the support frame body 31 can be prevented.

Figure 4:
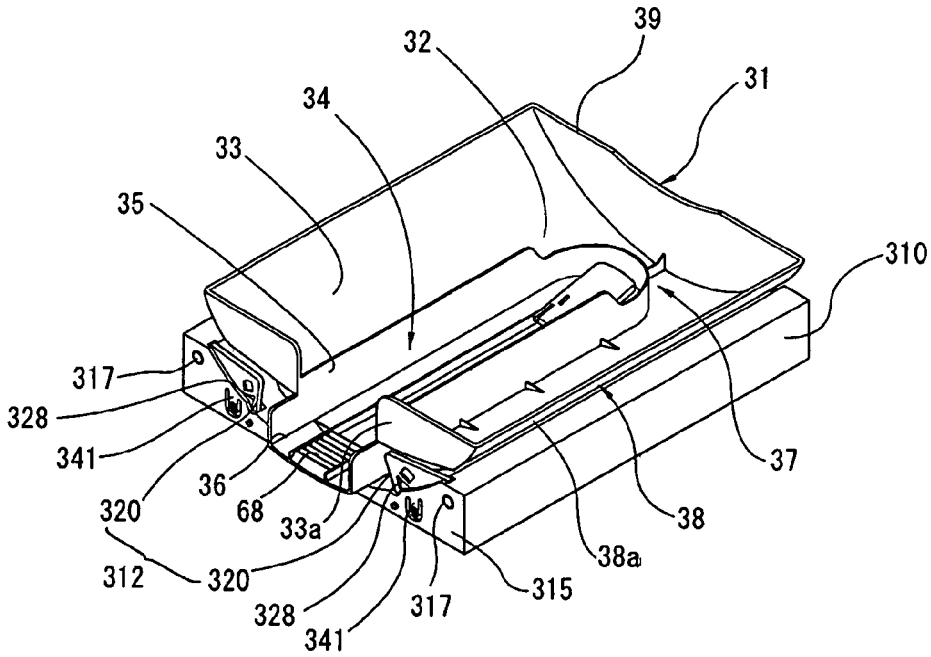
FIG. 4 is a perspective view showing a state where the support frame body is mounted on the pedestal in another mode.

Further, as another example of the adjustment stopper means 312, as shown in FIG. 4, a front wall 315 of the pedestal 310 is formed into the same arcuate shape as the swing receiving surface 311, and engaging members 320, 320 which project and retract are pivotally supported on left and right portions of the front wall 315. In the drawing, numeral 317 indicates pivotal supporting portions and numeral 328 indicates guide grooves.

Accordingly, due to a projecting operation of one engaging member 320, one engaging member 320 and the constitutional member of the support frame body 31 described later are brought into contact with and are engaged with each other thus restricting the swing range of the support frame body 31. Due to the projecting and retracting operation of the other engaging member 320, the support frame body 31 can swing without causing the interference between one engaging member 320 and the constitutional member of the support frame body 31.

The engaging members 320, 320 which act in the above-mentioned manner are constituted as follows.

Figure 5:
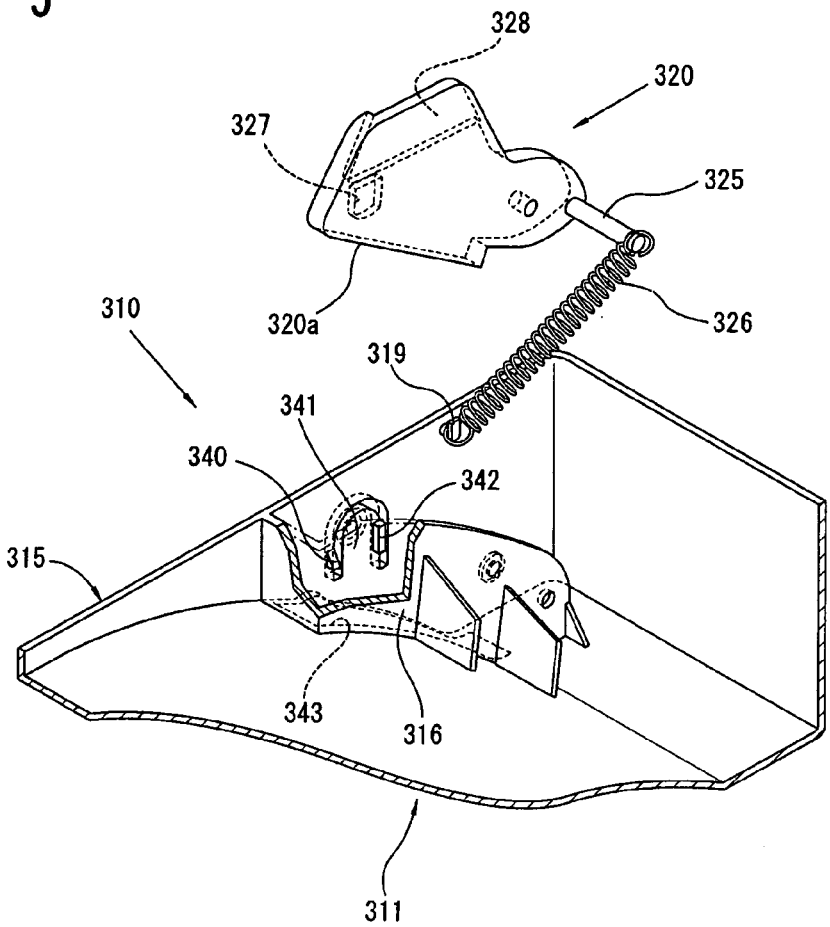
FIG. 5 is an exploded perspective view showing a state before an engaging member is mounted on a rear surface of the pedestal in another mode.
Figure 6:
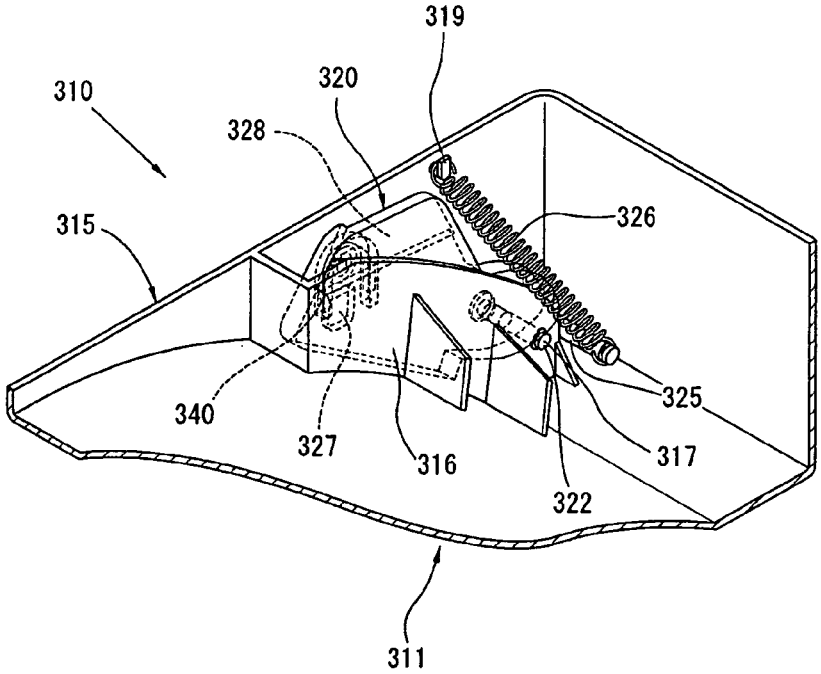
FIG. 6 is an perspective view showing a state where the engaging member is mounted on the rear surface of the pedestal in another mode.

That is, as shown in FIG. 5 and FIG. 6, inside the front wall 315 of the pedestal 310, auxiliary walls 316 stand upright while maintaining a fixed distance between the front wall 315 and the auxiliary walls 316. The plate-shaped engaging member 320 is arranged between the front wall 315 and the auxiliary walls 316 in a projectable and retractable manner.

The structure which allows the engaging members 320, 320 projectable and retractable is as follows.

That is, the engaging member 320 is pivotally supported on a pin 322 which extends between the front wall 315 and the auxiliary walls 316 (see FIG. 6), and the engaging member 320 is rotatable about the pivotally supporting portion 317 so that the engaging member 320 is projected from and retracted into an opening portion 343 formed between the front wall 315 and the auxiliary walls 316.

Further, a spring 326 is interposed between a rear surface of the front wall 315 and the engaging member 320, wherein the engaging member 320 is biased in a projection state due to a biasing force of the spring 326 and is brought into pressure contact with a rear side of the front wall 315.

That is, the spring 326 extends between a support pin 325 which is mounted in a projecting manner on an end portion of the engaging member 320 which is positioned closer to a proximal end side than the pivotally supporting portion 317 and an engaging portion 319 formed on a rear surface of the front wall 315. Due to a biasing force of the spring 326, a front-side surface of the engaging member 320 is brought into pressure contact with the rear side of the front wall 315. When the engaging member 320 retracts due to such a pressure contact action, a recessed portion 327 formed in the engaging member 320 is engaged with a triangular projection 340 formed on a rear surface of the front wall 315 thus holding the engaging member 320 in a retracted state.

Figure 10:
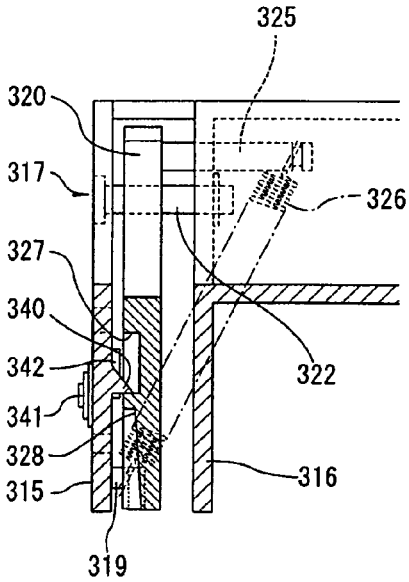
FIG. 10 is a cross-sectional view taken along a line A-A in FIG. 9.
Figure 11:
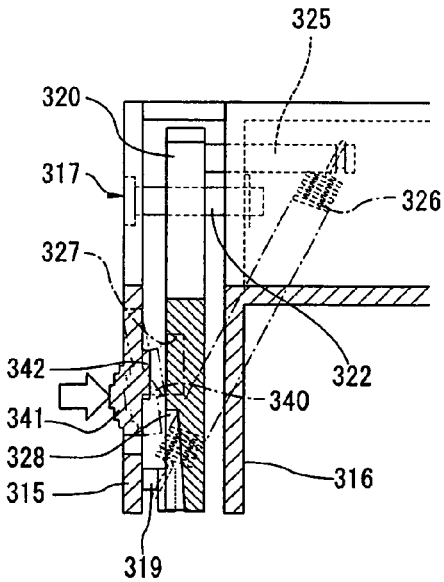
FIG. 11 is a cross-sectional view taken along a line B-B in FIG. 9.

That is, as shown in FIG. 5 and FIG. 10, the projection 340 and the recessed portion 327 perform a stopper function for holding the engaging member 320 in a retracted state. Further, a cutout tongue 341 is formed on the front wall 315 and an engagement releasing projecting portion 342 (see FIG. 5 and FIG. 11) is formed on the cutout tongue 341. When a patient pushes the cutout tongue 341 from a front side of the front wall 315 with his finger, the engagement releasing projecting portion 342 pushes the engaging member 320 to a rear side so that the engagement between the recessed portion 327 of the engaging member 320 and the projection 340 is released (see FIG. 10) so that it is possible to return the engaging member 320 into a projected state from a retracted state.

Further, an upper edge of the engaging member 320 has the same curved surface as the concave arcuate shape of the outer bottom surface 38*a* of the support frame body 31 described later so as to conform with the outer bottom surface 38*a*.

Figure 8:
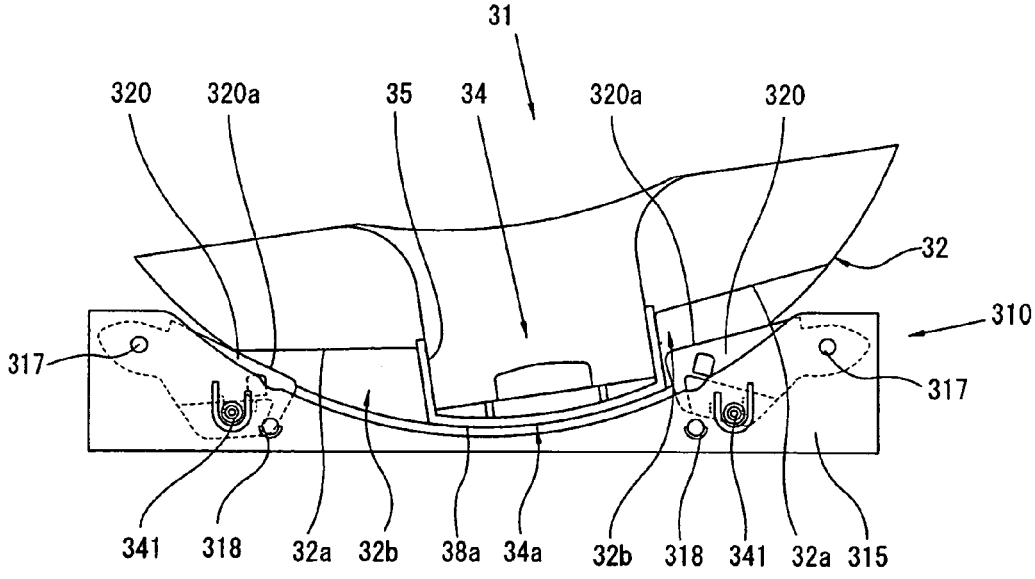
FIG. 8 is a front view showing a state where the support frame body is mounted on the pedestal in another mode.

That is, in swinging the support frame body 31 on the pedestal 310, as shown in FIG. 8, either one of left and right portions of the outer bottom surface 38*a* of the support frame body 31 is brought into contact with an upper end surface of a distal end of the engaging member 320, and the engaging member 320 is pushed down due to the further swinging of the support frame body 31 so that the engaging member 320 is retracted inside the front wall 315.

Here, the retracting action of the engaging member 320 is performed by rotating the engaging member 320 about the pivotally supporting portion 317.

Figure 7:
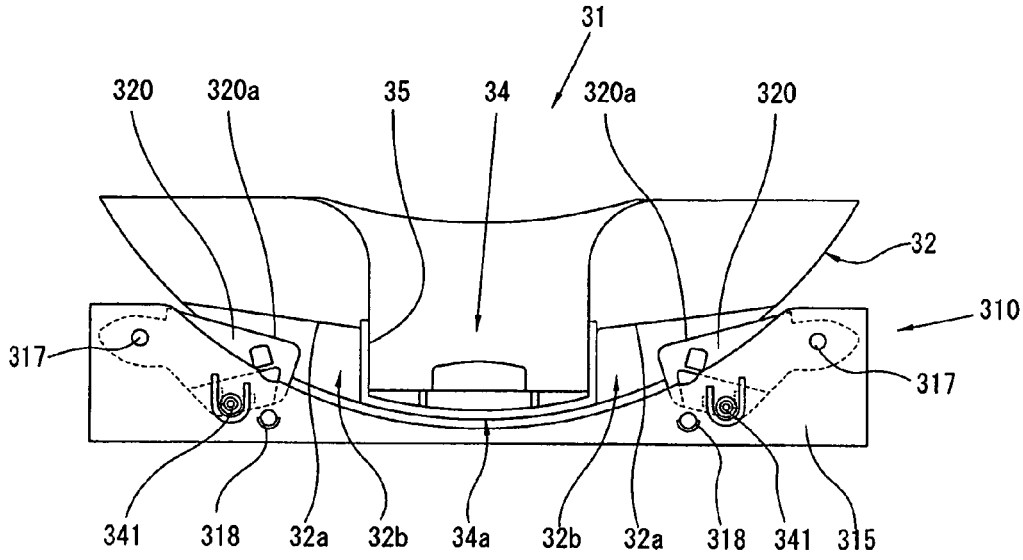
FIG. 7 is a front view showing a state where the support frame body is mounted on the pedestal in another mode.

When the support frame body 31 swings and returns to the original position so that the contact between the outer bottom surface 38*a* and the engaging member 320 is released, as shown in FIG. 7, the engaging member 320 projects due to a biasing force of the spring 326 (see FIG. 6) and is brought into a state where the engaging member 320 projects from an upper edge of the front wall 315.

Figure 12:
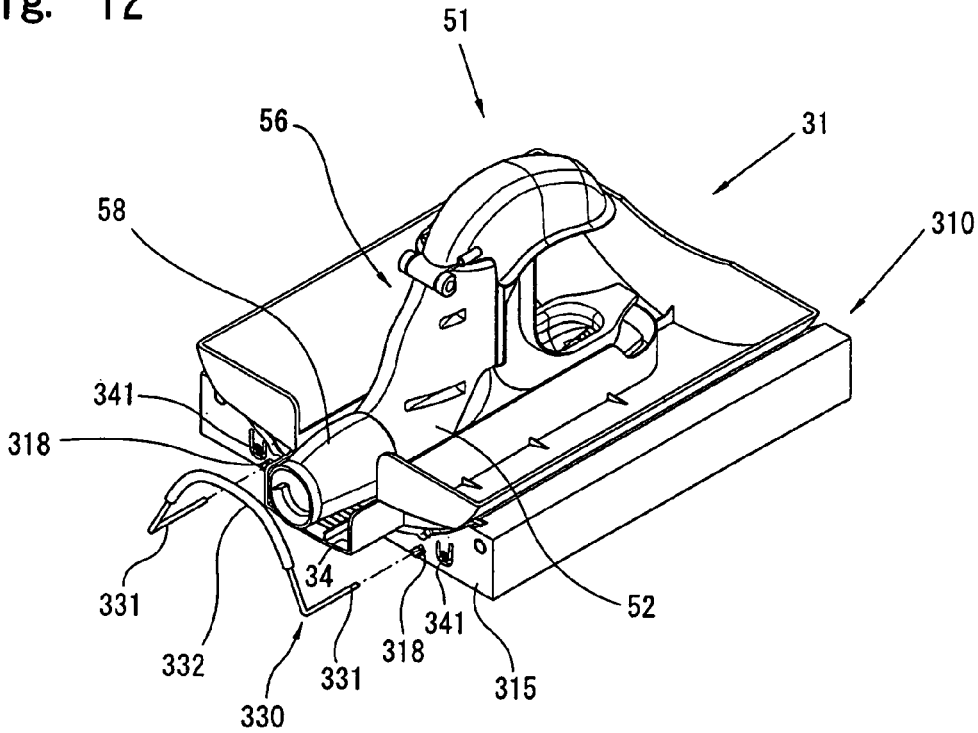
FIG. 12 is a perspective view showing a state before a fecal and urinary treatment unit is fixed to a pedestal by a fixing jig.

Further, as shown in FIG. 12, insertion holes 318, 318 are formed on left and right sides of the front wall 315 of the pedestal 310 and left and right free ends 331, 331 of a fixing jig 330 made of wire, a hard line coated with a tube or the like and having an approximately mountain-like shape can be inserted into the insertion holes 318, 318.

Figure 13:
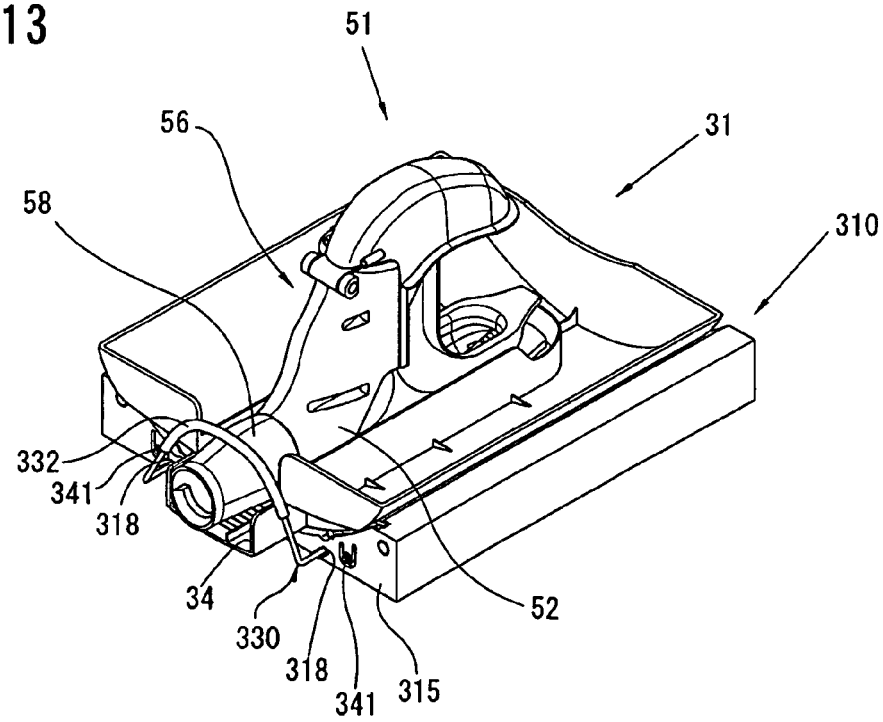
FIG. 13 is a perspective view showing a state where fecal and urinary treatment unit is fixed to the pedestal by the fixing jig.

That is, as shown in FIG. 13, the fixing jig 330 is used for fixing the fecal and urinary treatment unit 51, and fixes with pressure a coupling 58 which is contiguously formed with the horizontal member 52 of the treating body 56 to an inner bottom surface of a guide passage 34 by the body portion 332 formed in an approximately mountain-like shape.

Here, free ends 331, 331 which are formed in a projecting manner toward a front side are inserted into the insertion holes 318, 318 formed in the front wall 315 of the pedestal 310.

The free ends of the fixing jig 330 are inserted into the insertion holes 318, 318 and project to the rear side of the front wall 315 of the pedestal 310. The projecting free ends 331, 331 are configured to be brought into contact with lower end surfaces of the engaging members 320, 320 so that a range where the engaging members 320, 320 retract inside the pedestal 310 is restricted.

(iii) The Support Frame Body 31 is Explained.

As shown in FIG. 2 to FIG. 4, the support frame body 31 is mounted on the pedestal 310. The support frame body 31 is formed of a box-shaped rectangular casing 39 which has an opening on an upper end thereof. The rectangular casing 39 has a bottom plate 32 whose outer bottom surface 38*a* is (see FIG. 2) formed into a convex arcuate shape.

That is, an outer peripheral wall 33 stands upright at an outer peripheral edge of the bottom plate 32 in a state where a height of the outer peripheral wall 33 is smaller than at least a thickness of the buttock placing pad 41 (see FIG. 1) described later. Further, a strip-shaped guide passage 34 which extends in the longitudinal direction is formed in a center portion of the bottom plate 32. Both sides of the guide passage 34 form guide walls 35.

The guide passage 34 penetrates a frame-body front wall 33*a* on a downstream side and protrudes from a downstream end of the bottom plate 32 on a downstream side such that the distal end of a projecting portion 36 is open-ended. Accordingly, in mounting the support frame body 31 on the pedestal 310 which is fitted into the mounting hole 12 formed in the mattress 11 (see FIG. 1), the projecting portion 36 of the guide passage 34 is fitted into a pipe passage 13 which is communicated with the mounting hole 12.

In the support frame body 31 having such a constitution, a U-shaped space 37 which has a substantially U shape is provided between the outer peripheral wall 33 and the strip-shaped guide passage 34. An inner bottom surface of the U-shaped space 37 is formed into a concave arcuate shape. The substantially U-shaped buttock placing pad 41 described later is fitted into and held by the U-shaped space 37.

The support frame body 31 which forms the outer bottom surface 38*a* thereof (see FIG. 2) into a convex arcuate shape is placed on the pedestal 310 whose inner bottom surface is formed into a concave arcuate shape in a laterally swingable manner, and swings corresponding to the movement of the buttocks or the hips of the patient as described later so as to absorb the displacement of buttocks of the patient.

Further, as shown in FIG. 4, the support frame body 31 has the structure which is cooperatively operated with the adjustment stopper means 312 of the pedestal 310 such that although the support frame body 31 swings corresponding to the displacement or the movement of the buttock of the patient on the pedestal 310, the swing angle is restricted to a fixed angle.

That is, a strip-shaped guide passage 34 is provided at the center of the support frame body 31 and, as described previously, the guide passage 34 penetrates the frame body front wall 33*a* and protrudes to the outside of the support frame body 31. As a matter of course, guide walls 35 which form both sides of the guide passage 34 protrude from the frame body front wall 33*a*.

When the support frame body 31 having such structure is mounted on the pedestal 310, projections 313, 313 which are arranged on left and right sides of the front wall 315 of the pedestal 310 are arranged to face outer surfaces of the guide walls 35 in an opposed manner.

Accordingly, when the support frame body 31 is swung in one direction, a distal end of the projection 313, 313 of the pedestal 310 comes into contact with the support frame body 31 thus preventing the further swinging of the support frame body 31.

To allow the swinging of the support frame body 31 within such a fixed range, it is necessary to form flat surfaces 32*a* on the bottom plate 32 by cutting away only portions of the front end portion of the bottom plate 32 which is formed into a convex arcuate shape, that is, only front end portions of the bottom plate 32 having a convex arcuate shape on lateral sides of the guide walls 35 projecting frontward from the bottom plate 32.

That is, as shown in FIG. 7, when the support frame body 31 is at a neutral position where the support frame body 31 is not swung, the engaging members 320 of the pedestal 310 are positioned in spaces 32*b* formed by the flat surfaces 32*a* so that the engaging members 320 do not interfere with the bottom plate 32 of the support frame body 31 thus allowing the swinging of the support frame body 31.

Such a swing range is limited to a range within which the projecting projections 313, 313 come into contact with the guide walls 35.

Figure 9:
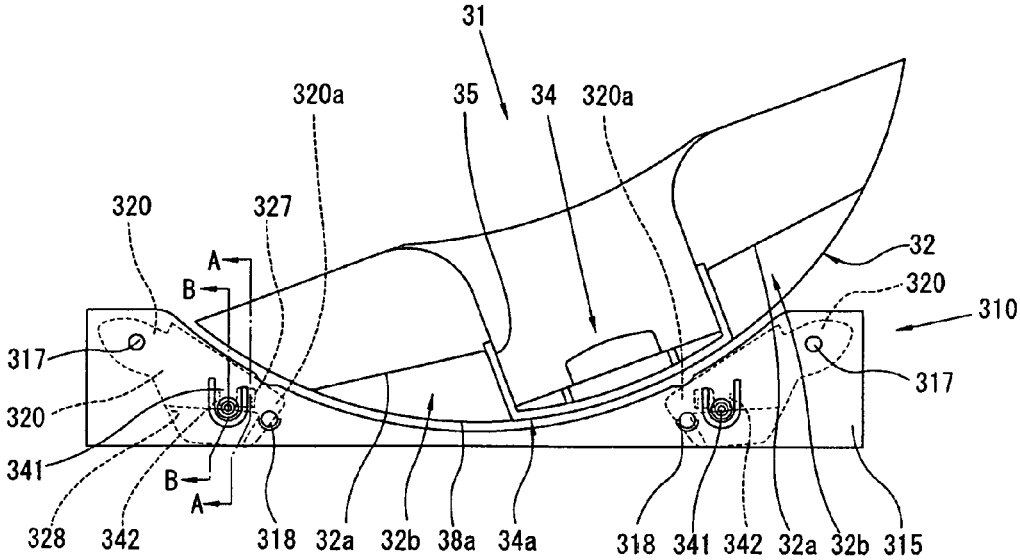
FIG. 9 is a front view showing a state where the support frame body is mounted on the pedestal in another mode.

However, as shown in FIG. 9 and FIG. 10, when the further swing of the support frame body 31 is requested, the engaging members 320, 320 are manually pushed down and fixed against a biasing force of the spring. In such a state, the outer bottom surface 34*a* of the guide passage 34 slides on an upper edge portion of the engaging member 320.

That is, when the engaging member 320 which is in contact with the guide wall 35 is pushed down and is retracted against the biasing force of the spring, the contact between the engaging member 320 and the guide wall 35 is released. Accordingly, as shown in FIG. 9, the outer bottom surface 34*a* of the guide passage 34 goes over the upper end surface 320*a* of the engaging member 320, 320 so that the support frame body 31 further swings whereby a swing angle is increased. Such a manually-obtained retracting state of the engaging member 320 is fixed by the above-mentioned engagement between the projection 340 and the recessed portion 327. The engagement can be manually released when the engagement release projection 342 of the cutout tongue 341 described previously is pushed by a finger.

(iv) The Buttock Placing Pad 41 is Explained.

The buttock placing pad 41 (see FIG. 1) is also formed in a substantially U-shape to be fitted into the U-shaped space 37 having a substantially U-shape formed on the support frame body 31. The buttock placing pad 41 is constituted such that the guide wall 35 of the guide passage 34 of the support frame body 31 can be fitted into the central U-shaped cutout portion 42.

The buttock placing pad 41 uses a pad in which a soft material such as urethane is filled. The material provides stable mounting of the patient's buttocks when the buttocks are placed on the buttock placing pad 41 and gives the patient a feel which is friendly to a surface of the patient's buttocks. It is particularly necessary for the material to be excellent not only in water-proofing, water-repellent and water-absorbing properties but also in ventilation property which implies that the material does not hold moisture. It is also necessary for the buttock placing pad 41 to be made of the material having texture which can prevent the patient from suffering bedsores.

A thickness of the buttock placing pad 41 is set at least equivalent to a depth of the mounting hole 12 formed in the mattress 11 and is set larger than a height of the outer peripheral wall 33 (see FIG. 2) of the support frame body 31.

When the buttock placing pad 41 is fitted and fixed to the mounting hole 12 which is fitted into the U-shape space 37 formed in the support frame body 31, the guide walls 35 of the guide passage 34 of the support frame body 31 are fitted into the U-shaped cutout space 42 formed at the approximately center of the buttock placing pad 41. Accordingly, the approximately U-shaped buttock placing pad 41 surrounds guide passage 34.

Accordingly, in a state where the buttock placing pad 41 is fitted into the U-shaped space 37 formed in the support frame body 31, the U-shaped cutout space 42 formed in the buttock placing pad 41 and the guide passage 34 is formed into an integral space.

Further, a bottom surface of the buttock placing pad 41 is formed into a convex arcuate shape. Accordingly, when the buttock placing pad 41 is fitted into the U-shaped space 37 in the support frame body 31, the bottom surface of the buttock placing pad 41 agrees with an inner bottom surface of the support frame body 31 having a concave arcuate shape.

Further, the U-shaped space 37 formed in the support frame body 31 has an advantageous effect that even when the washing water leaking from the inside of the fecal and urinary treatment unit 51 infiltrates into the buttock placing pad 41 through a peripheral surface of the buttock placing pad 41, leaked water is reserved thus preventing a rear surface of the mattress 11 from becoming wet.

(iv) The Fecal and Urinary Treatment Unit 51 is Explained Below.

Figure 15:
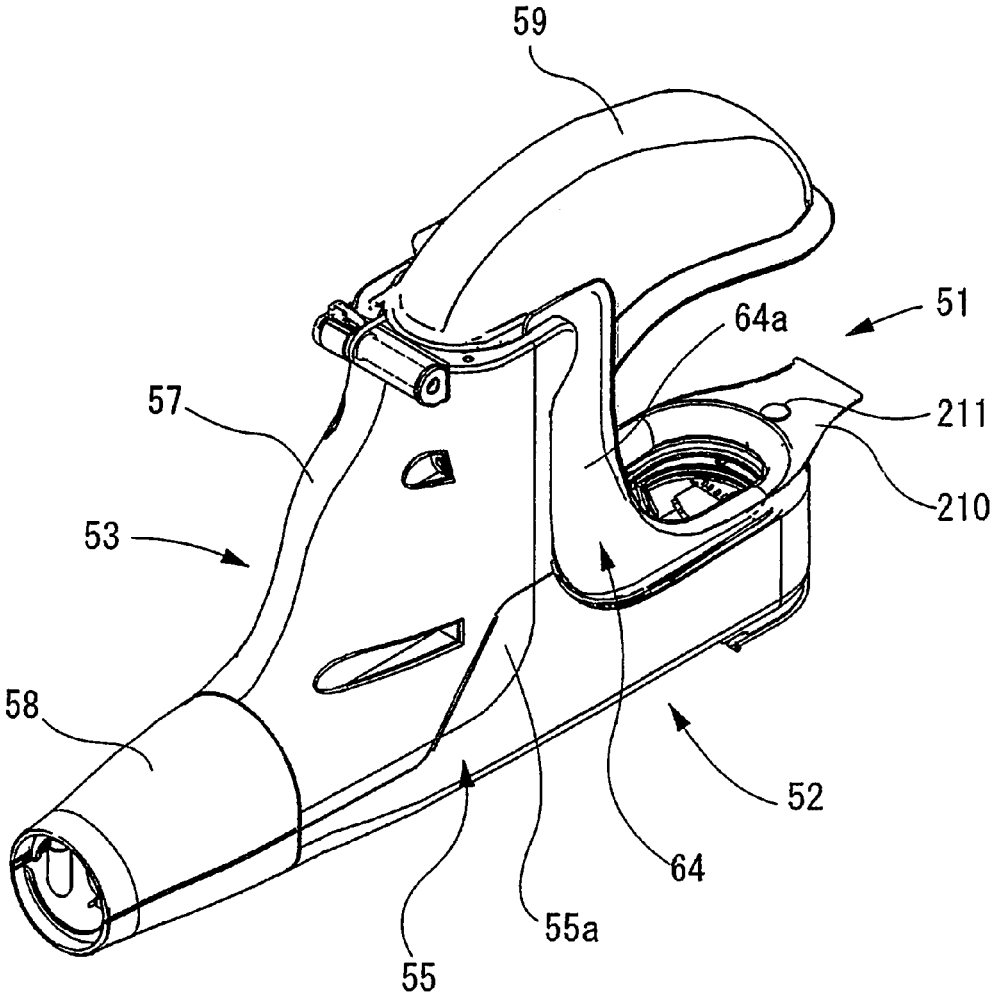
FIG. 15 is a constitutional view showing a state where the fecal and urinary treatment unit is mounted on the support frame body.

As shown in FIG. 15, the fecal and urinary treatment unit 51 is constituted of a support casing 55 having a substantially oblong shape which is fitted into the guide passage 34 of the support frame body 31 whose outer bottom surface is formed into a convex arcuate shape (see FIG. 2), and an approximately L-shaped treating body 56 which is fitted into and housed in the support casing 55.

Figure 16:
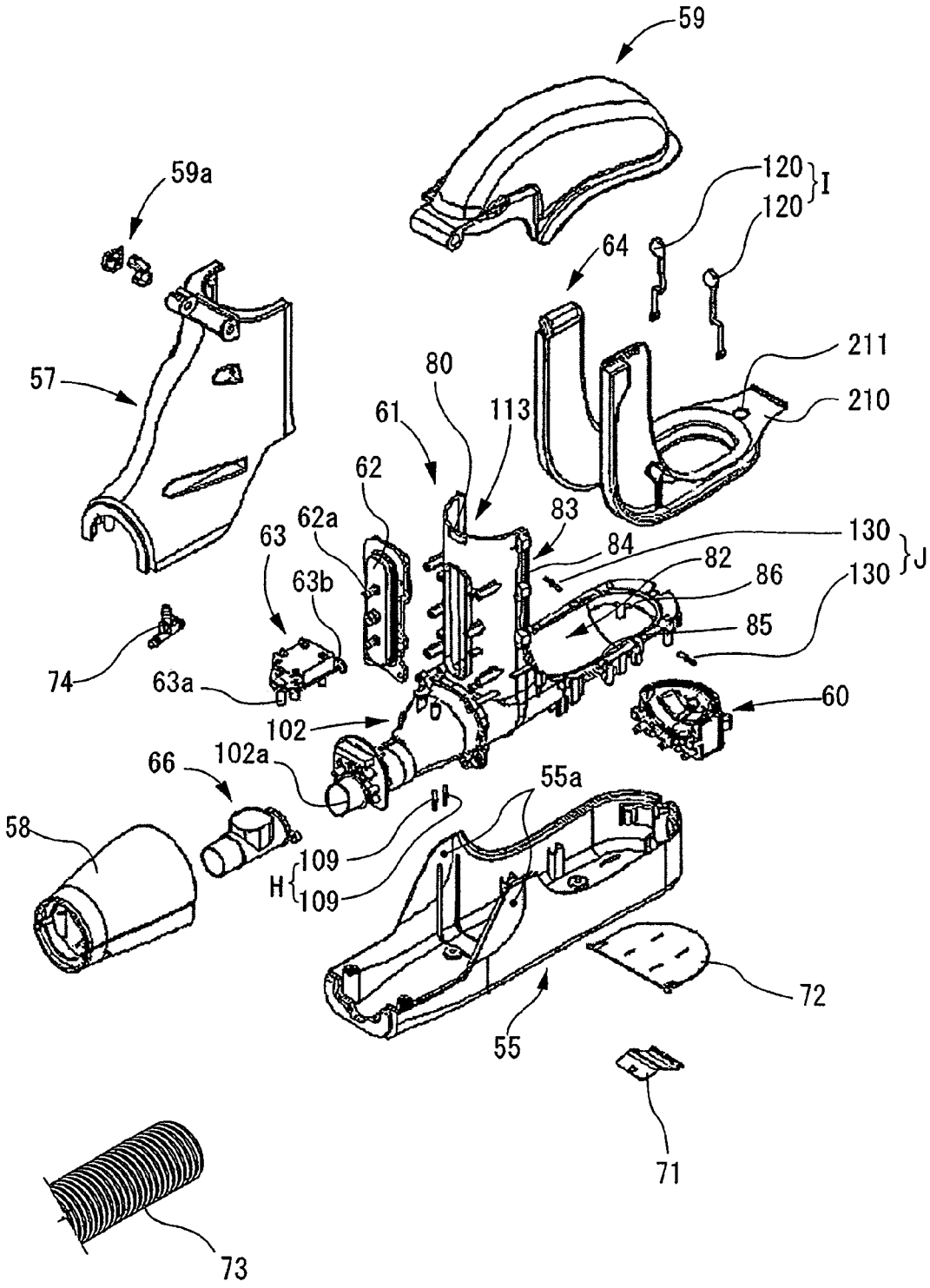
FIG. 16 is an exploded perspective view of the fecal and urinary treatment unit.

As shown in FIGS. 16 and 17, the support casing 55 is provided with a peripheral wall on a periphery thereof and is formed into a rectangular shape so as to house the horizontal member 52 of the treating body 56 (described later) therein. Both the right and left side walls of the support casing 55 have center portions thereof raised in a chevron shape. These raised portions 55*a* and an opening edge of the latter half portion of the support casing 55 are provided to allow a vertical casing 57 to be fitted in the support casing 55. The vertical member 57 is formed in an arcuate shape in cross section and in a substantially L-shape as seen from the side so as to house the backside of the vertical member 57 of the substantially L-shaped treating body 56 described later and a part of an upper surface of the treating body 56.

A cylindrical coupling 58 is connected to an end opening on the downstream side formed in assembling the support casing 55 and the vertical member 57. Into the coupling 58, a discharge passage 81 for urine and stools provided at the downstream end of the treating body 56 described later (see FIG. 17) and a discharge pipe 103 which is communicated with the discharge passage 81 (see FIG. 1) are inserted.

Since the support casing 55 of the fecal and urinary treatment unit 51 is swung laterally on the pedestal 310 together with the support frame body 31, a connecting portion between a discharge passage 81 of the fecal and urinary treatment unit 51 and a discharge pipe 103 is configured to be rotatable in the coupling 58. Accordingly, it is necessary to make the center line of rotation of the fecal and urinary treatment unit 51 which swings in the pedestal 310 agree with the center line of rotation of the rotation connecting portion between the discharge passage 81 and the discharge pipe 103.

Further, as shown in FIG. 17, a cover body 59 which covers private parts of the patient from above is pivotally attached to the upper edge of the vertical casing 57 which covers the vertical member 80 of the treating body 56 from a back side.

The cover body 59 is formed into a dome shape and a proximal end of the cover body 59 is pivotally attached to the upper end of the vertical casing 57 using a pin 59*a*. The cover body 59 can cover the private parts from above in an open/close manner in a state where the patient holds the treating body 56 in the crotch of his legs.

In this manner, the treating body 56 can be fully covered by the support casing 55, the vertical casing 57, the coupling 58 and the cover body 59 except for a nozzle projecting portion adapted to carry out necessary functions for treating urine and stools.

As shown in FIG. 16 and FIG. 17, such a treating body 56 is constituted of the urination and defecation container 82 which has the inside thereof formed into a boat shape and is used as the horizontal member, and the washing nozzle retainer 61 which stands upright on the downstream end portion of the urination and defecation container 82 and is used as a vertical member. The treating body 56 is formed into a L-shape due to the urination and defecation container 82 and the washing nozzle retainer 61.

Figure 21A:
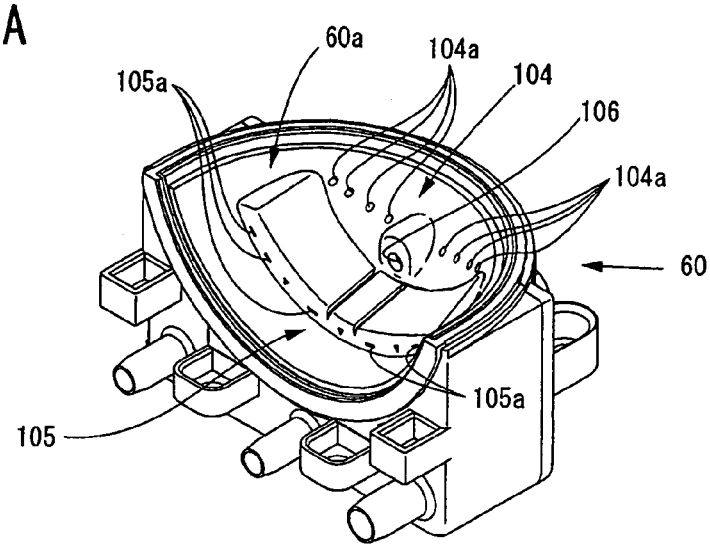
FIG. 21A is a perspective view of a front-end nozzle bracket.
Figure 21B:
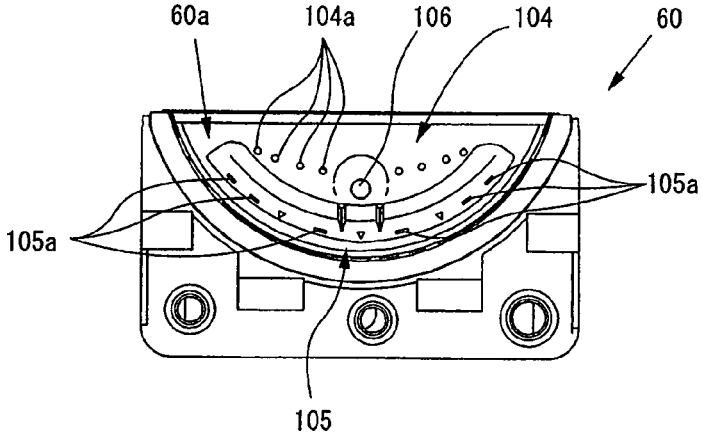
FIG. 21B is a front view of the front-end nozzle bracket.

As shown in FIG. 16 and FIG. 21, a front end nozzle bracket 60 is provided at the front end of the urination and defecation container 82. The front end nozzle bracket 60 is provided with an injection nozzle 105 for jetting water to wash away the urine and the stools remaining in the urination and defecation container 82 in the downstream direction. Adjacently provided near the injection nozzle 105 is an air supply nozzle 205 for drying the lower surface of the buttocks and the hips of the patient.

As shown in FIG. 17, the downstream end of the urination and defecation container 82 on the downstream side is provided with a discharge port 102*a* adapted to discharge urine and stools remaining in the urine and defecation container 82 to an external storage tank 300 through a discharge pipe 103.

Figure 20:
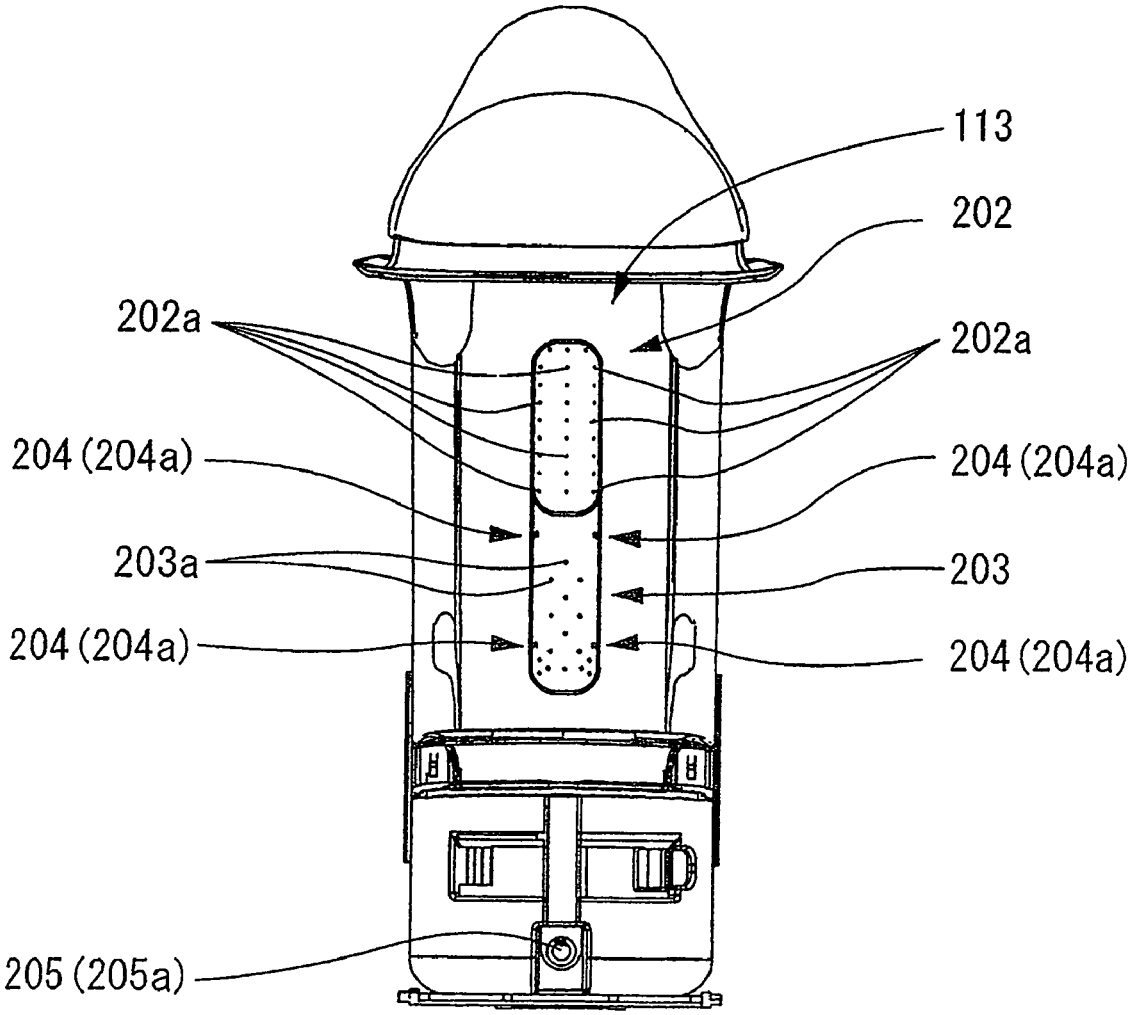
FIG. 20 is a front view of various nozzles.

As shown in FIG. 17 and FIG. 20, the washing nozzle retainer 61 is provided with a washing nozzle 203, a bidet nozzle 202 and a drying nozzle 204 which are configured to send water or air toward the private parts and the anus of the patient.

Figure 18:
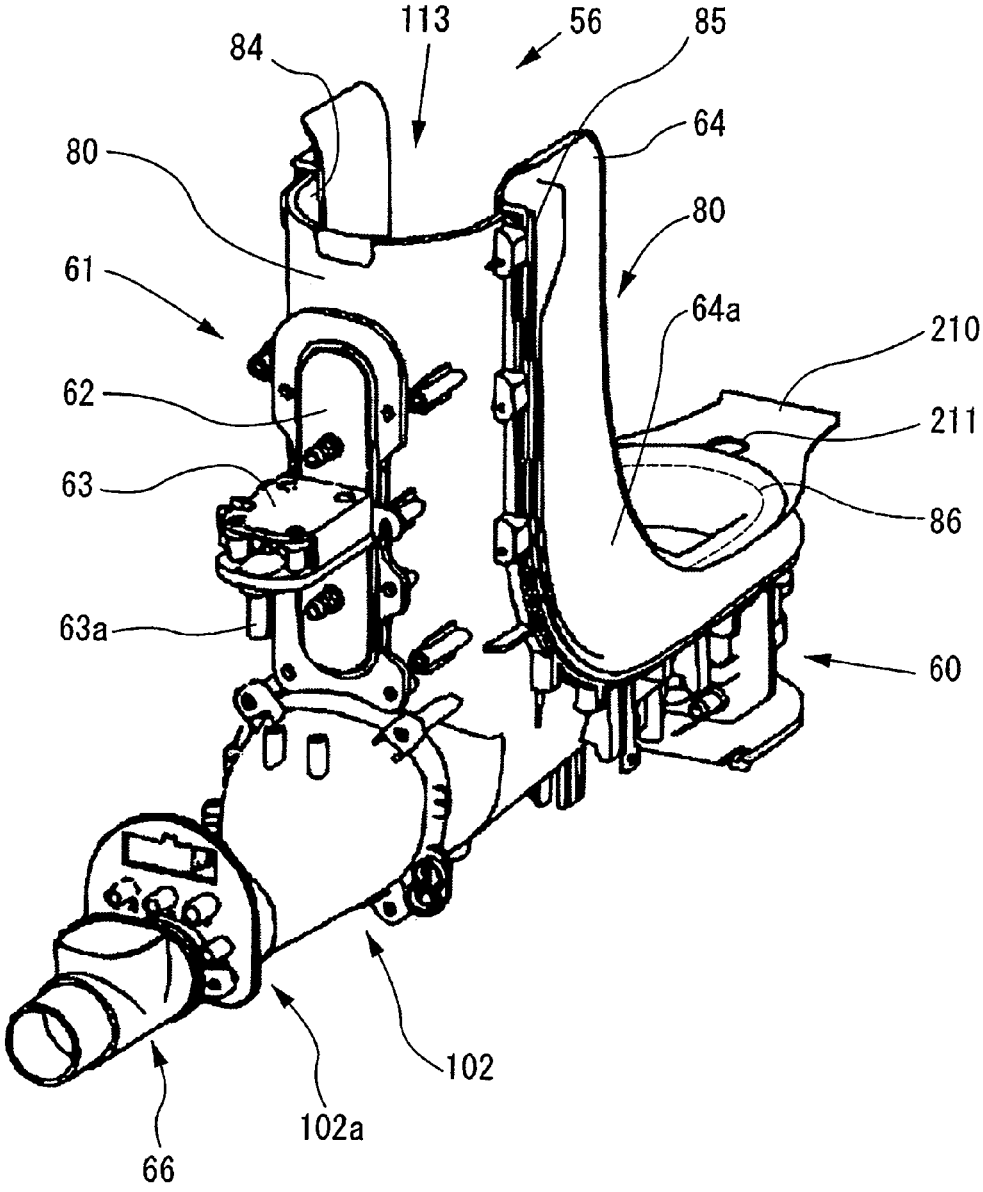
FIG. 18 is a perspective view of the treating body.

As shown in FIG. 16 to FIG. 18, a proximal end of the pipe leading to each nozzle projects from a rear surface of the washing nozzle retainer 61 and is communicated with a required branch pipe 62*a* of a distributor 62 attached to the rear surface of the washing nozzle retainer 61. On the rear side of the distributor 62, a heater portion 63 is mounted on the upper surface of the washing nozzle retainer 61 serving as the vertical member of the treating body 56, wherein an air pipe in communication with the distributor 62 is heated through the heater portion 63.

The heater portion 63 is provided with a suction port 63*a* and an injection port 63*b* (see FIG. 16). Air sent from the suction port 63*a* is heated by the air pipe and sent as warm air through the injection port 63*b*.

As shown in FIG. 16 to FIG. 18, in a treating body 56 which includes a urination and defecation container 82 formed into a boat shape and a washing nozzle holding body 61 provided downstream of the urination and defecation container 82 and is formed into an approximately L shape as a whole, an opening portion 83 of the treating body 56 and a nozzle projecting side of the washing nozzle holding body 61 face each other and respective edge portions are contiguously formed in an L-shaped manner. That is, an opening edge 84 of the treating body 56 and the side edge of the washing nozzle holding body 61 constitute a contiguous side edge portion 85 having an approximately L shape as viewed in a side view.

Then, these left and right side edge portions 85, 85 are covered with an edge portion covering body 64 whose shape is formed by combining an L-shape and a U-shape for covering the edge portions.

Numeral 210 indicates a tongue which extends from a front end of the edge portion covering body 64.

Figure 19:
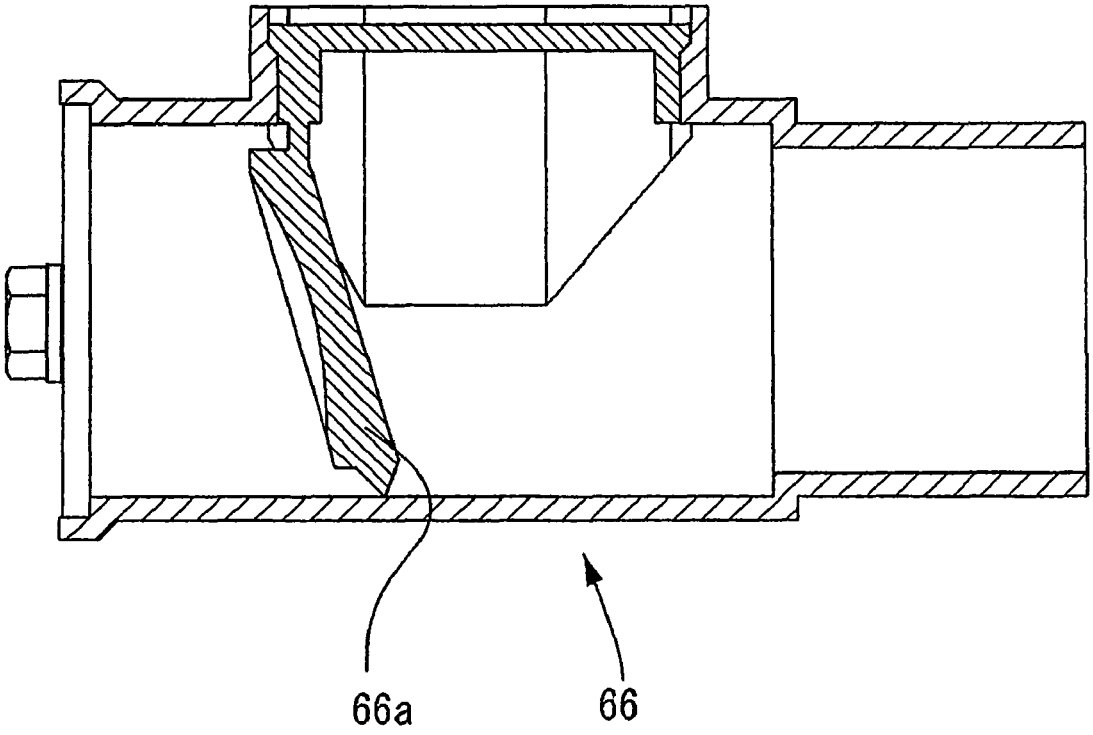
FIG. 19 is a cross-sectional view of a backflow prevention valve casing.

As shown in FIGS. 16 and 17, a hollow check valve casing 66 of an octagonal shape in cross section is interposed between the discharge port 102*a* of the urination and defecation container 82 and the rear anchor side of the discharge pipe 103 (see FIG. 14) to prevent the excretory substance and a foul odor from flowing back. The check valve casing 66 is vertically provided with an openable and closable backflow prevention valve 66*a* (see FIG. 19) whose upper end is pivotally supported at the ceiling surface of the check valve casing 66. The backflow prevention valve 66*a* is always biased in the valve-closing direction by its own weight. The excretory substance such as urine and stools goes into circulation more smoothly with a circulating force against a biasing force of the valve generated by its own weight, while the inflow of the foul odor from the storage tank 300 and the discharge pipe 103 is prevented by the valve closure.

Further, as shown in FIG. 17, an engaging hook 67 having a chevron shape in cross section is formed on a substantially central portion of a bottom surface of the support casing 55. Engaging grooves 68 in multi stages (see FIG. 2) having a chevron shape in cross section are formed on a downstream portion of a bottom surface within the guide passage 34 of the support frame body 31 into which the support casing 55 is fitted.

In the case where the fecal and urinary treatment unit 51 is removed from the patient, by lifting the fecal and urinary treatment unit 51 upwards, the engaging hook 67 of the fecal and urinary treatment unit 51 is disengaged from the engaging grooves 68. Thus, the fecal and urinary treatment unit 51 can be easily removed from the patient.

Between the upstream side within the guide passage 34 of the support frame body 31 and the bottom surface of the support casing 55 on the upstream side, a substantially Z-shaped leaf spring 71 (see FIG. 16) for pushing up the bottom surface of the fecal and urinary treatment unit 51 on the upstream side and a substantially arcuate push-up backing plate 72 mounted on the upper surface of the leaf spring 71 are interposed.

(vi) Various Nozzles and Sensors Mounted on the Fecal and Urinary Treatment Unit 51 are Explained.

Figure 14:
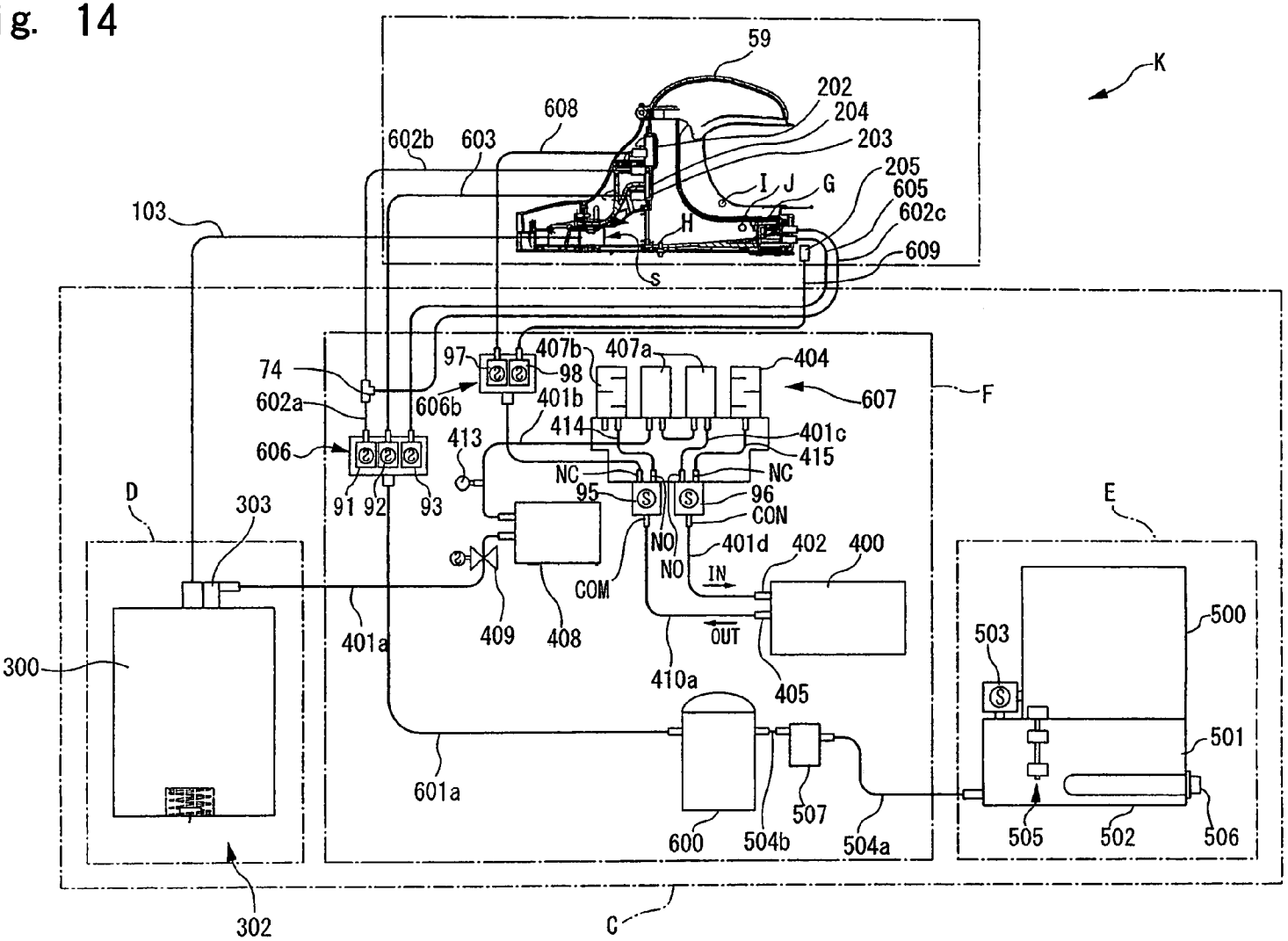
FIG. 14 is a constitutional view showing the constitution of the automatic fecal and urinary treatment device according to this embodiment.

As shown in FIGS. 14 and 17, the fecal and urinary treatment unit 51 is provided in various places with a buttocks nozzle 104, an injection nozzle 105, a bidet nozzle 202, and a washing nozzle 203 for jetting washing water to wash each region of the human body, a drying nozzle 204 and an air supply nozzle 205 for jetting air to dry the private parts and external buttocks of the human body after washing, a fitting sensor I, a stool sensor G a urine sensor H, and a water level sensor J.

(vi-1) Various Nozzles are Explained in Detail.

As shown in FIGS. 17 and 20, the fecal and urinary treatment unit 51 is provided with the washing nozzle 203 arranged on the lower end portion of the bottom surface of a front surface recessed portion 113, and the bidet nozzle 202 arranged on the bottom surface of the front surface recessed portion 113 at a position higher than the washing nozzle 203. The fecal and urinary treatment unit 51 is also provided with the injection nozzle 105 arranged on end portion of the discharge passage 81 on a side opposite to the discharge portion 102, and the buttocks nozzle 104 arranged on the end portion of the discharge passage 81 on a side opposite to the discharge portion 102 at a position higher than the injection nozzle 105.

As shown in FIG. 1, the respective nozzles 104, 105, 202, 203 are connected to a buttocks nozzle pipe 602*c*, an injection nozzle pipe 604, a bidet nozzle pipe 602*b*, and a washing nozzle pipe 603, respectively. Thus, washing water is respectively supplied from a processing operating portion C to respective nozzles 104, 105, 202, 203 through each nozzle pipes 602*c*, 604, 602*b*, 603.

These various pipes are tied in a bundle to be inserted into an ornamental hose 73.

As shown in FIGS. 17 and 21, the buttocks nozzle 104 is provided with a plurality of buttocks-use injection ports 104*a* whose injection directions are directed toward the buttocks of the patient. The injection ports 104*a* are arranged in such a manner that each port has a predetermined curvature to correspond to the curved surface of the buttocks for enabling the washing of a larger area of the buttocks.

The buttocks nozzle 104 is communicably connected to the bidet nozzle 202 through a three-way valve 74. Both nozzles 104 and 202 are configured to be capable of simultaneously injecting washing water from the three-way valve 74.

The injection nozzle 105 is a nozzle for performing the treatment of washing away the stools from the discharge passage 81 to the discharge port 102*a*, while crushing the stools to pieces by the injection water pressure of the washing water (hereinafter referred to as "stool crushing treatment"). The injection nozzle 105 is arranged in a projecting portion 60*a*. The injection nozzle 105 has a plurality of stool crushing injection ports 105*a* whose injection directions are directed to the bottom surface of the discharge passage 81 and to the area just below the anus of the human body where the stools are tend to be accumulated most. Further, the injection nozzle 105 is in communication with a pressure pump 600 described later and is designed to inject warm water from a warm water tank 501 through the injection nozzle 105 as washing water at high water pressure.

As shown in FIG. 17 and FIG. 20, the bidet nozzle 202 is a nozzle, as a main injection range, for washing the excretory substance adhering to the private parts of the human body and for washing the urine adhering to the inner periphery of the vertical member of the treating body. The bidet nozzle 202 is provided with a plurality of bidet injection ports 202*a* which are formed in line and at regular intervals, wherein the injection direction of the bidet injection ports 202*a* is directed to the private parts of the patient. The bidet nozzle 202 is also provided with a plurality of urine injection ports 200*b* which are formed at regular intervals on the periphery of the bidet nozzle 202 having a projecting shape so that the injection direction is directed to the inner peripheral surface of the vertical member of the treating body.

As shown in FIGS. 17 and 20, the washing nozzle 203 has a narrow elongated shape so as to wash the anus and the area around the anus irrespective of the difference of body type by sex. The washing nozzle 203 is provided at a position lower than the bidet nozzle 202 and is provided with a plurality of anus injection ports 203*a* which are formed at regular intervals, wherein the injection direction of the injection ports 203*a* is directed to the anus and an area around the anus of the patient.

As shown in FIGS. 17 and 20, the drying nozzle 204 is a nozzle, as an injection range, for drying the private parts, the anus and an area around the anus of the patient. The drying nozzle 204 is situated further to the outer side than the bidet nozzle 202 and is integrally formed with the bidet nozzle 202. The drying nozzle 204 is also provided with four drying injection ports 204*a* which are formed at regular intervals, wherein the injection direction of the drying injection ports 204*a* is directed to the private parts, the anus, and an area around the anus of the patient. The drying nozzle 204 is provided in such a manner that, to enable the injection of warm air, air supplied from a suction pump and supplied from the drying nozzle pipe 608 through a solenoid valve 97 (see FIG. 14) is heated by a heater of a heater portion 63 to discharge warm air through the drying injection port 204*a*.

Figure 21C:
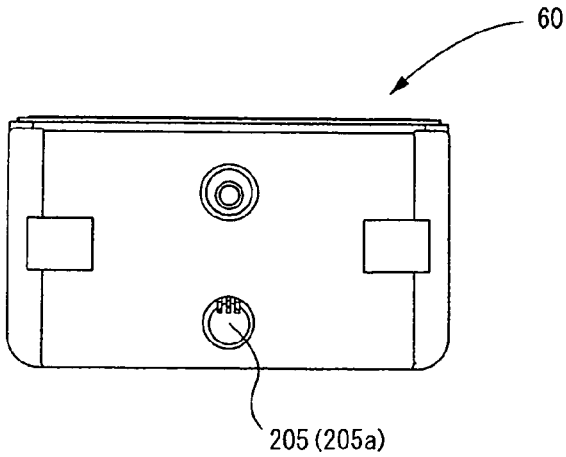
FIG. 21C is a rear view of the front-end nozzle bracket.

As shown in FIGS. 17 and 21C, the air supply nozzle 205 is a nozzle, as an injection range, for drying an area around the buttocks of the patient as an injection range. An air supply injection port 205*a* is directed upward so that the injection direction is directed to an area around the buttocks of the patient. The air supply nozzle 205 is provided to inject, from an air supply injection port 205*a*, air which is supplied from a suction pump to enable the injection of air and is supplied from an air supply nozzle pipe 609 through a solenoid valve 98 (see FIG. 1).

(vi-2) Structure of Various Sensors is Explained Below in Detail.

The fitting sensor I has a pair of electrode terminals 120, 120 made of conductive rubber. When both electrodes 120, 120 are brought into close contact with thighs of the patient at a constant pressure, the fitting sensor I detects that the fecal and urinary treatment unit has been fitted on the thighs of the patient based on a change of electrostatic capacity peculiar to the human body.

As shown in FIG. 17, the stool sensor G detects whether or not there are stools between the light-emitting portion 106 and the light-receiving portion 107, in other words, in the discharge passage 81, based on whether or not the infrared light emitted from the light-emitting portion 106 is received at the light-receiving portion 107 facing the light-emitting portion 106.

Further, as shown in FIGS. 16 and 17, the urine sensor H is provided with a pair of electrode pins 109, 109 which is adjacently arranged in the longitudinal direction.

With such an arrangement, when the patient defecates and/or urinates, the fecal and urinary treatment unit 51 detects the stools and the urine by the stool sensor G and the urine sensor H and the detected signal is sent to the processing operating portion C (see FIG. 14). The processing operating portion C which receives such a detected signal performs an operation to supply washing water to the bidet nozzle pipe 602*b*, the washing nozzle pipe 603, the injection nozzle pipe 605, and the buttocks nozzle pipe 602*c*. The washing water is then injected into the inside of the fecal and urinary treatment unit 51 from each nozzle of the bidet nozzle 202, the washing nozzle 203, the injection nozzle 105, and the buttocks nozzle 104.

The water level sensor J is provided, as shown in FIGS. 16 and 17, with electrode pins 130, 130 at the side edge portions 85, 85 of the urination and defecation container 82 on the upstream side to detect the water level within the urination and defecation container 82.

(vii) The Processing Operating Portion C which Constitutes the External Processing Structure is Explained Below.

As shown in FIG. 14, the processing operating portion C is constituted of: an excretory substance housing portion D for accommodating human urine and stools discharged from the fecal and urinary treatment unit 51; a nozzle operating portion F for receiving, from the fecal and urinary treatment unit 51, a fitting signal which shows a close contact condition between the crotch of the patient's legs and the fecal and urinary treatment unit 51 at a constant pressure, a detection signal of defecation and/or urination, and a water level signal showing the water level rising in the urination and defecation container, and for performing consequent various operations such as supplying of water or supplying of air; and a washing water supply portion E for supplying washing water to the fecal and urinary treatment unit 51.

(vii-1)

The excretory substance housing portion D has a storage tank 300. The storage tank 300 is connected to the discharge port 102*a* of the fecal and urinary treatment unit 51 through the discharge pipe 103.

As shown in FIG. 14, a suction pipe 401*a* is connected to a hose connecting portion 303 adjacent to the discharge pipe 103.

(vii-2)

The washing water supply portion E includes: as shown in FIG. 14, a raw water tank 500 for supplying raw water serving as the washing water; a warm water tank 501 for heating the washing water supplied into the fecal and urinary treatment unit 51 to a predetermined temperature; and a solenoid valve 503 for controlling water supply from the raw water tank 500 to the warm water tank 501. The warm water tank 501 includes a pipe heater 502 for heating the raw water supplied from the raw water tank 500 through the solenoid valve 503, a water level sensor 505 for detecting water level, and a temperature sensor 506 for detecting a water temperature.

The washing water supply portion E detects a temperature of the raw water in the warm water tank 501 using the temperature sensor 506, and heats the raw water with the pipe heater 502 thus forming warm water.

(vii-3)

The nozzle operating portion F is communicably connected, as described above, to the excretory substance housing portion D through the suction pipe 401*a* and is communicably connected to the washing water supply portion E through the water supply pipe 504*a*. In the drawing, reference numeral 401*a* is a suction pipe, reference numeral 409 indicates a suction valve as a valve, 408 indicates a vacuum tank as a pressure reducing portion, 401*b* indicates a suction pipe, 407*a* indicates a primary foul odor eliminating filter, 413 indicates a pressure switch, 401*c* indicates a suction pipe, 401*d* indicates a suction pipe, 400 indicates a suction pump, 402 indicates a suction port, 405 indicates a discharge port, 414 indicates an air discharge pipe, and 407*b* indicates a muffler.

On the other hand, the water supply pipe 504*a* is connected to the buttocks nozzle 104, the injection nozzle 105, the bidet nozzle 202, and the washing nozzle 203 within the fecal and urinary treatment unit 51 through a filter 507, a water supply pipe 504*b*, a pressure pump 600, a nozzle pipe 601*a*, various solenoid valves such as 91, 92, 93, a three-way valve 74, and various nozzle pipes such as 602*a*, 602*b*, 602*c*, 603, and 605.

By forming a vacuum state in a vacuum tank 408, a stronger negative pressure is generated in the vacuum tank 408 so that urine and stools in the inside of the fecal and urinary treatment unit 51 can be efficiently sucked.

Further, the solenoid valves 95, 96, the muffler 404, two sets of deodorizing filters 407*a*, 407*a* and the muffler 407*b* are formed into a unit thus constituting a filter assembly 607.

The structure of the automatic fecal and urinary treatment device K and the treatment steps of urination and defecation have been explained heretofore, another technical feature of the present invention lies in that, in the above-mentioned structure, when the support frame body 31 placed on the pedestal 310 is swung excessively, a washing operation in the treatment steps is stopped. That is, the pedestal 310 is provided with the adjustment stopper means 312, 312 which restrict the swinging of the support frame body 31. However, in a state where the restriction on swinging is released by retracting the engaging member 320 of the adjustment stopper means 312 in the rear surface of the pedestal 310, when a patient largely displaces or twists his hips so that a washing operation is operated in a state where the support frame body 31 is largely swung, there exits possibility that washing water leaks to the outside of the fecal and urinary treatment unit 51 and smears the mattress 11 or the diaper 21. Under such circumstances, the inventors of the present invention have developed a following technique which allows a patient to receive comfortable washing treatment even when such a state occurs.

That is, the support frame body 31 includes a detection means which detects a swing state of the support frame body 31. When the detection means detects that the support frame body 31 of the fecal and urinary treatment unit 51 swings within a fixed range or more, a washing operation in a defecation treatment step or a washing operation in a urination treatment step described later is stopped.

As the above-mentioned detection means which detects a swing state of the support frame body 31, a magnetic sensor 230 described later, an infrared sensor or a gradient sensing sensor is used. Besides the above-mentioned parts, an electronic device such as an angle sensor which directly calculates a swing angle is named as the detection means.

Figure 22:
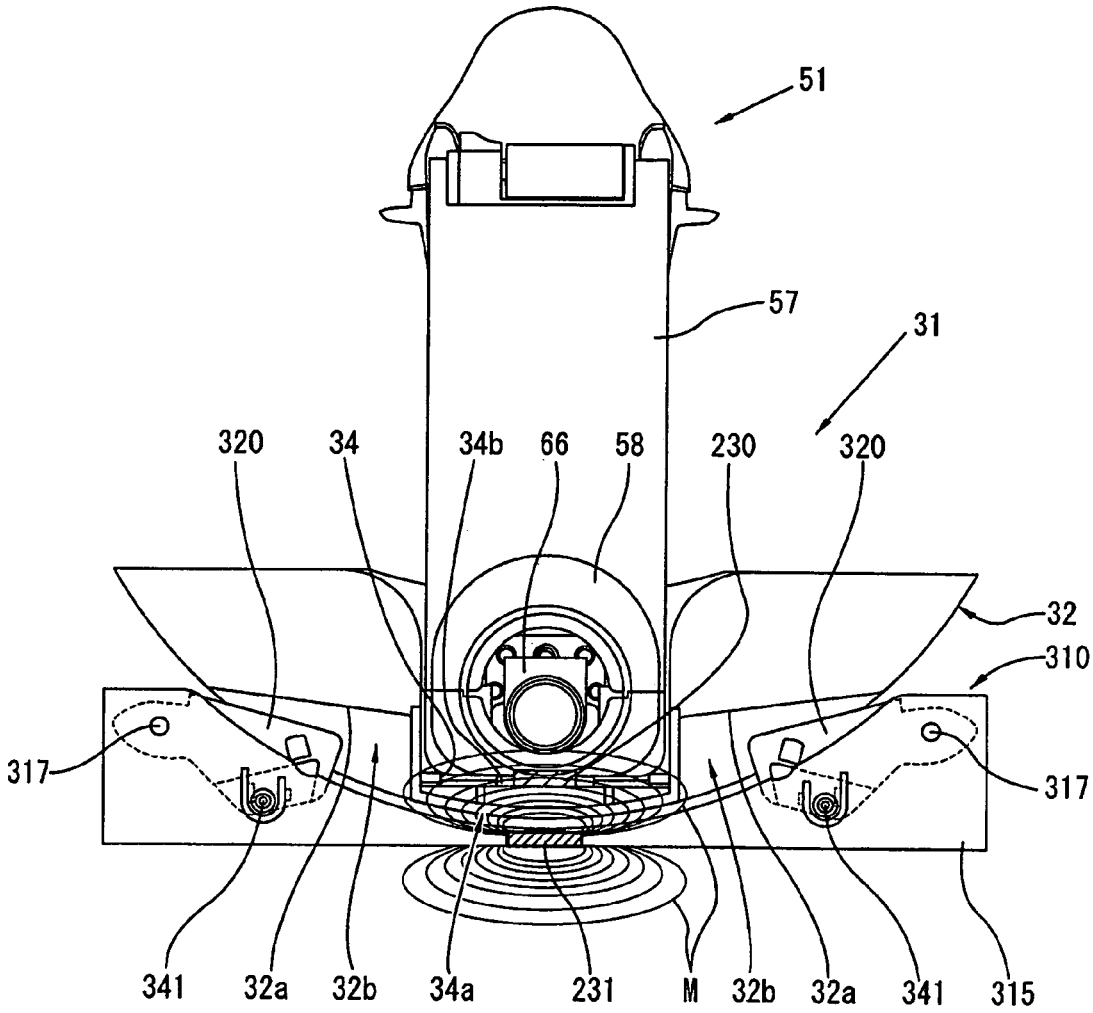
FIG. 22 is a front view showing an inclined state of the support frame body.

As the above-mentioned detection means, as shown in FIG. 22, there is provided a magnetic sensor 230 which detects a swing angle by sensing a magnetic field M of a magnet 231 mounted on the pedestal 310.

The magnet 231 is arranged at the center position in the widthwise direction of the pedestal 310, and generates a magnetic field M toward the support frame body 31 above the magnet 231.

The magnetic sensor 230 is mounted in an insertion hole 34*a* of the guide passage 34 formed in the support frame body 31. The magnetic sensor 230 senses a magnetic field M generated by the magnet 231 corresponding to a swing angle of the support frame body 31, and transmits a predetermined signal corresponding to the swing angle to the treatment operation part C. Here, the magnetic sensor 230 is connected to the treatment operation part C via wiring (not shown in the drawing).

Next, operation states of the magnetic sensor 230 at respective swing angles of the support frame body 31 are explained.

Figure 23:
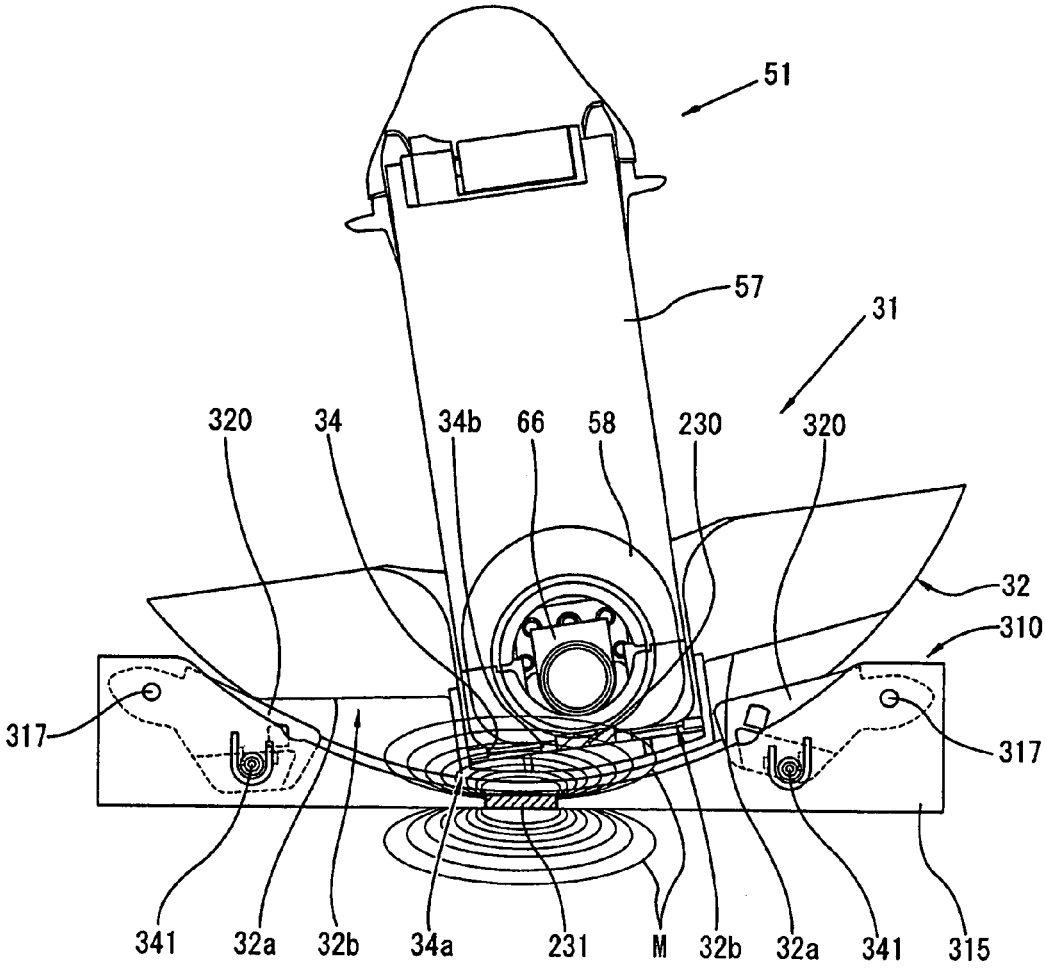
FIG. 23 is a front view showing an inclined state of the support frame body.

FIG. 22 shows a state where the swing angle which becomes a reference point of the support frame body 31 with respect to the pedestal 310 is 0°. FIG. 23 shows a state where the support frame body 31 is swung little with respect to the pedestal 310 and the swing angle of the support frame body 31 is 5°.

In a state where the swing angle of the support frame body 31 falls within a range from 0° to 14°, the magnetic sensor 230 senses the magnetic field M of the magnet 231 and transmits a predetermined signal to the treatment operation part C. The treatment operation part C determines whether or not the swing angle transmitted from the magnetic sensor 230 described later is a fixed angle or more. That is, since the swing angle which falls within a range from 0° to 14° is smaller than the fixed angle, a step of starting a washing operation in the defecation treatment step or in the urine treatment step is performed.

Next, a solenoid valve 91 is closed, a solenoid valve 92 is opened and a pressurizing pump 600 is operated only for a predetermined time. Due to such an operation, warm water is supplied to the washing nozzle pipe 603 from the warm water tank 501 and is injected as washing water from the washing nozzle 203 so as to wash stools adhered to a periphery of an anus of a patient (anus washing operation). The solenoid valve 92 is closed. Then, the buttock washing operation and the anus washing operation are repeated until the number of washing reaches twice.

Figure 24:
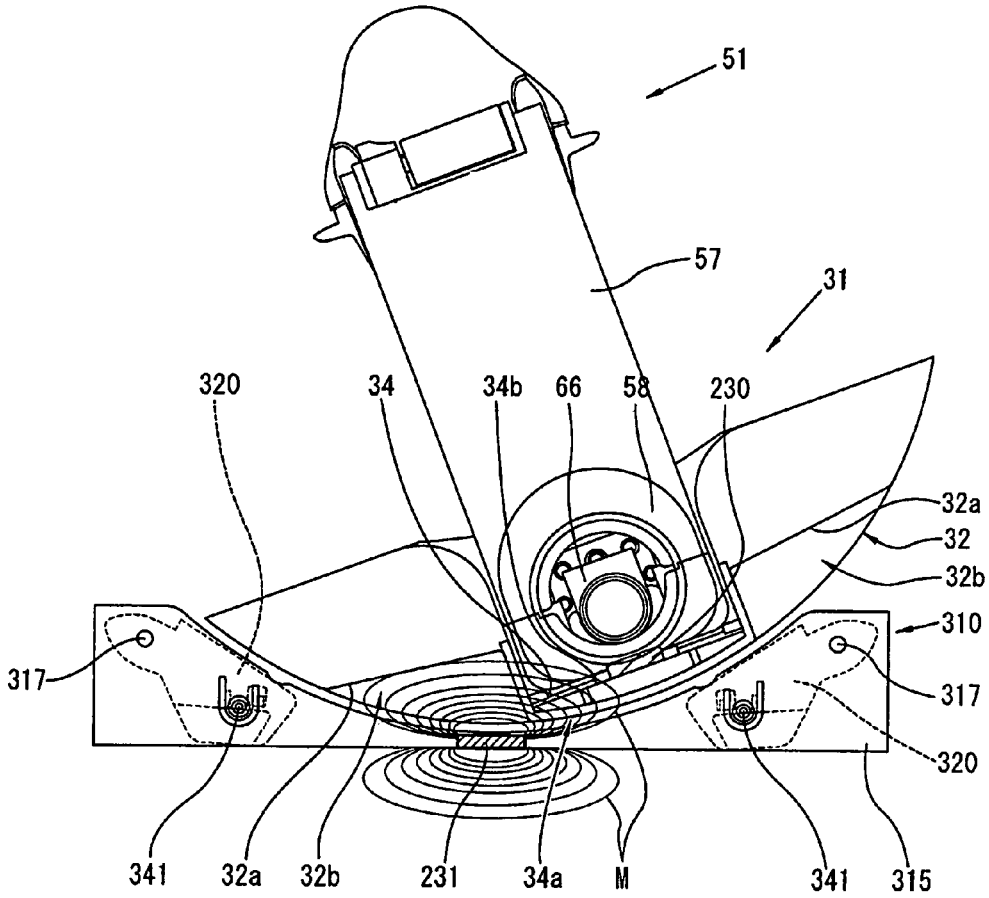
FIG. 24 is a front view showing a inclined state of the support frame body.

On the other hand, assume a case where the patient largely twists his hips largely so that the support frame body 31 is largely swung with respect to the pedestal 310 and the swing angle of the support frame body 31 with respect to the pedestal 310 becomes 15° (see FIG. 24). In this case, the magnetic sensor 230 cannot sense the magnetic field M of the magnet 231 and transmits a predetermined signal to the treatment operation part C. The treatment operation part C determines whether or not the swing angle of 15° which is transmitted from a magnetic sensor 230 described later is a fixed angle or more. When the treatment operation part C determines that the swing angle of 15° is more than the fixed angle, a control which stops a washing operation in the defecation treatment step or in the urine treatment step is performed.

That is, during the above-mentioned bidet washing operation and the above-mentioned buttock washing operation in the defecation treatment step and the urine treatment step, based on a control by the treatment operation part C which stops the above-mentioned washing operation, firstly, the solenoid valve 91 is closed from an open state and an operation of the pressurizing pump 600 is stopped. Accordingly, the supply of warm water to a pipe 602*a*, a three-way valve 74, a bidet nozzle pipe 602*b* and a buttock nozzle pipe 602*c* from the warm water tank 501 is stopped. That is, the supply of washing water which is injected to the periphery of private parts of a patient from the bidet nozzle 202 by way of the bidet nozzle pipe 602*b* is stopped (stopping of bidet washing operation). Further, the supply of washing water which is injected to the vicinity of buttocks of a patient from the buttock nozzle 104 by way of the buttock nozzle pipe 602*c* is stopped (stopping of buttock washing operation).

On the other hand, during the anus washing operation, the solenoid valve 91 is closed and the solenoid valve 92 is opened so that washing water is injected from the washing nozzle 203. Then, based on a control which stops the above-mentioned washing operation by the treatment operation part C, firstly, the solenoid valve 92 is closed and the operation of the pressurizing pump 600 is stopped. Due to such an operation, the injection of warm water to the washing nozzle pipe 603 from the warm water tank 501 is stopped so that the injection of washing water to the vicinity of the anus of the patient from the washing nozzle 203 is stopped (stopping of anus washing operation).

On the other hand, during the stools crushing treatment, the pressurizing pump 600 is operated so that warm water supplied from the warm water tank 501 in the raw water tank 500 is injected as washing water from the water injection nozzle 105 by way of the water injection nozzle pipe 605. Then, based on a control which stops the above-mentioned washing operation by the treatment operation part C, firstly, the solenoid valve 93 is closed and the operation of the pressurizing pump 600 is stopped. Due to such an operation, the supply of warm water to the water injection nozzle pipe 605 from the warm water tank 501 is stopped so that the injection of washing water to the discharge passage 81 from the injection nozzle 105 is stopped (stopping of washing operation for crushing stools).

Due to the above-mentioned constitution, when a patient largely twists his hips or his buttocks, the swinging is detected by the detection means and the above-mentioned respective washing operations are stopped when the detected swing angle is the fixed angle or more. Accordingly, the inadvertent elevation of a water level of the washing water stored in the fecal and urinary treatment unit 51 can be prevented and, further, there is no possibility that washing water leaks from the inside of the fecal and urinary treatment unit 51 and smears the diaper or the mattress 11 thus enabling the constant hygienic use of the automatic fecal and urinary treatment device.

Further, the present invention is also characterized in that a bent portion is formed on a portion of the urination and defecation passage.

Figure 25:
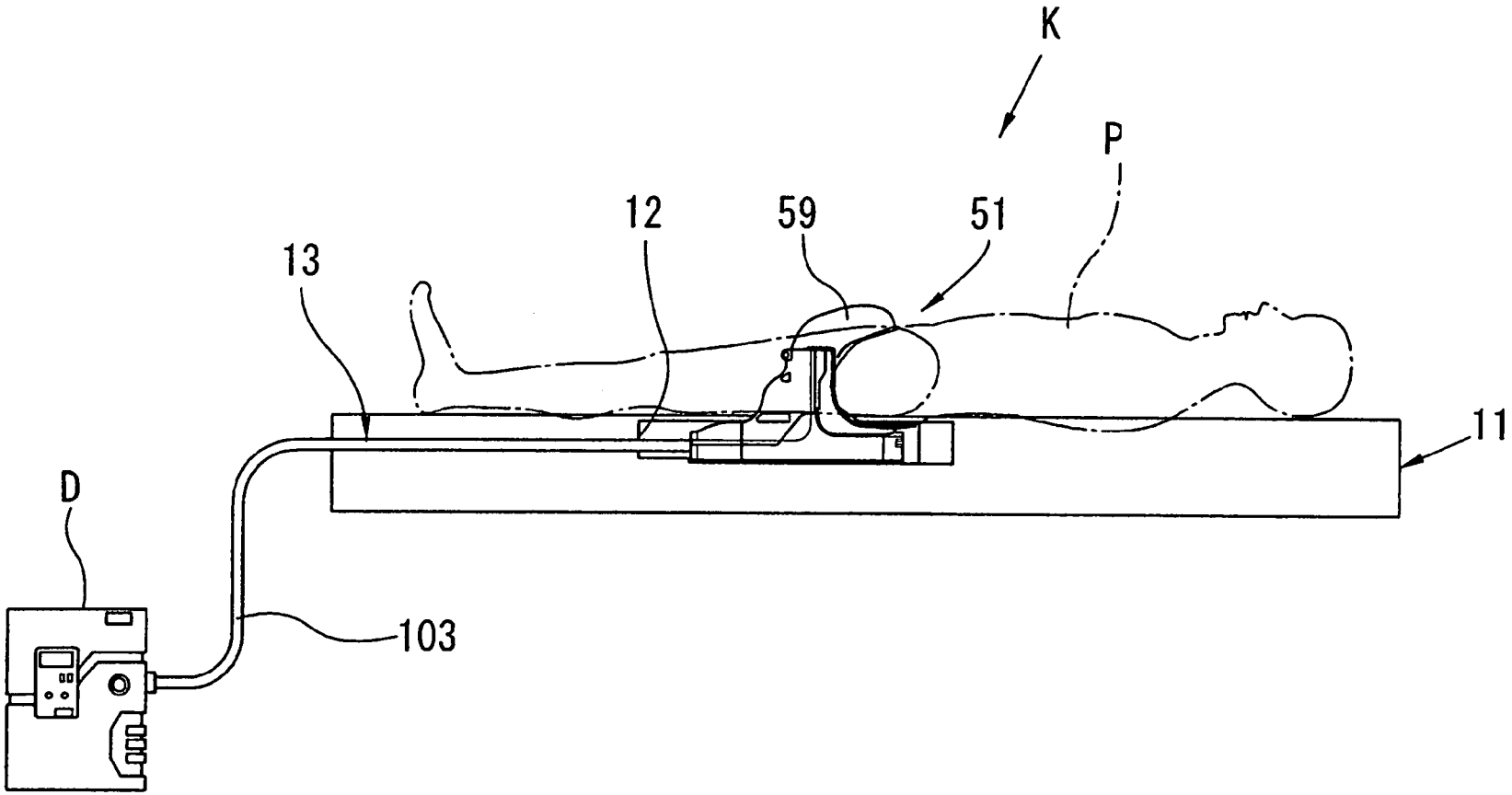
FIG. 25 is an explanatory view showing a use state of the automatic fecal and urinary treatment device according to this embodiment.

That is, as shown in FIG. 25, in conveying the discharged urine and stools and washing water discharged into the fecal and urinary treatment unit 51 from a patient P to the outside of the mattress 11 by way of the discharge pipe 103, by forming the bent portion 150 on a portion of the urination and defecation passage, the discharged urine and stools and washing water are stopped so that a water level is elevated whereby an upper space of the urination and defecation passage in a tubular cross-sectional direction is hermetically closed or narrowed. When a suction is made in such a state, since the upper space of the urination and defecation passage in a tubular cross-sectional direction is hermetically closed, the inside of the urination and defecation passage downstream of a portion where the discharged urine and stools and the washing water are stopped assumes a negative pressure state whereby the discharged urine and stools and the washing water are speedily conveyed toward the storage tank 300 of the excrement accommodating part D after passing the discharge passage 81 of the fecal and urinary treatment unit 51, the check valve casing 66 and the discharge pipe 103.

Further, when the discharged urine and stools and washing water flow in the bent portion 150 formed in the urination and defecation passage, a centrifugal force is generated in the discharged urine and stools and the washing water at a center position in a tubular cross section of the urination and defecation passage due to curvature of the bent portion 150 and hence, a first flow F1 which is directed toward an upper portion 150*a* from a lower portion 150*b* of the bent portion 150 (or toward the lower portion 150*b* from the upper portion 150*a*) is generated. Further, a pressure gradient force acts due to the difference in pressure distribution between the upper portion 150*a* and the lower portion 150*b* of a bent portion 150 of the urination and defecation passage and hence, a second flow F2 which is directed toward the lower portion 150*b* from the upper portion 150*a* (or toward the upper portion 150*a* from the lower portion 150*b*) of the bent portion 150 is generated. A vortex flow F3 is generated due to these first flow F1 and second flow F2. The discharged urine and stools and washing water generating such a vortex flow F3 can be speedily discharged to the outside of the urination and defecation passage.

Accordingly, the accumulation of the discharged urine and stools and washing water due to adhesion can be eliminated in the urination and defecation passage and hence, the generation of a foul odor from the urination and defecation passage can be prevented thus realizing the constant hygienic use of the automatic fecal and urinary treatment device.

Although the bent portion 150 is provided at any desired one portion of the urination and defecation passage, the bent portion 150 may be provided at a plurality of portions of the urination and defecation passage. Due to such a constitution, the conveyance of the discharged urine and stools and washing water in the fecal and urinary treatment unit 51 and in the urination and defecation passage ranging from an upstream end side to a downstream end side of the discharge pipe can be performed efficiently and reliably.

The accumulation of the discharged urine and stools and washing water due to adhesion can be eliminated in the discharge passage 81 of the urination and defecation passage and hence, the generation of a foul odor from the discharge passage 81 can be prevented thus realizing the constant hygienic use of the automatic fecal and urinary treatment device.

Since an air bag 151 has a crescent-roof shape in a bulged state, for example, the air bag 151 can efficiently stop the discharged urine and stools and washing water Z.

By adjusting a height of the air bag 151, it is possible to efficiently generate the vortex flow F3 in the discharged urine and stools and washing water Z which flow in the discharge passage 81 provided in the inside of the fecal and urinary treatment unit 51.

Figure 26:
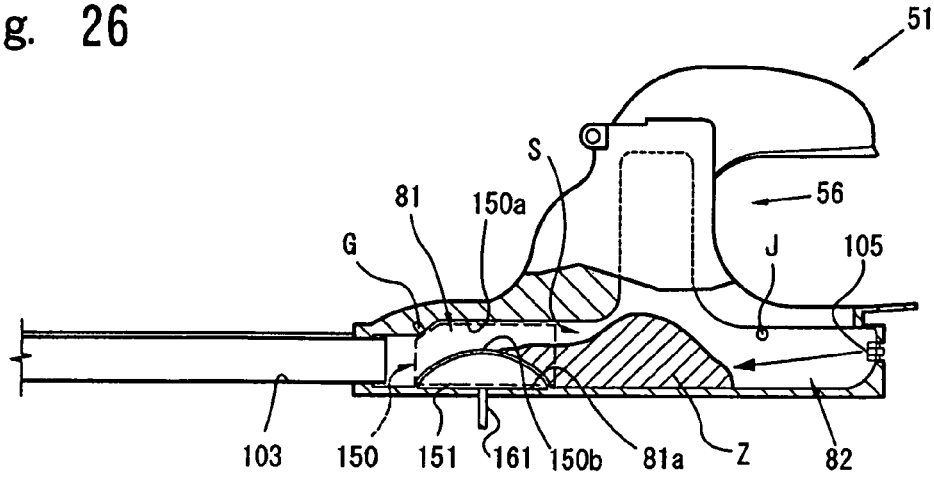
FIG. 26 is an explanatory view showing a treatment state of the urine and stools and washing water in the fecal and urinary treatment unit.
Figure 27:
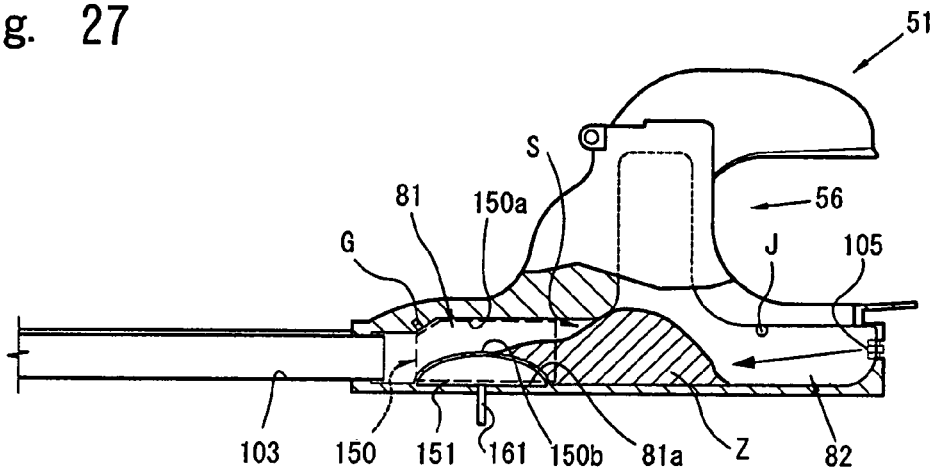
FIG. 27 is an explanatory view showing a treatment state of the urine and stools and washing water in the fecal and urinary treatment unit.
Figure 28:
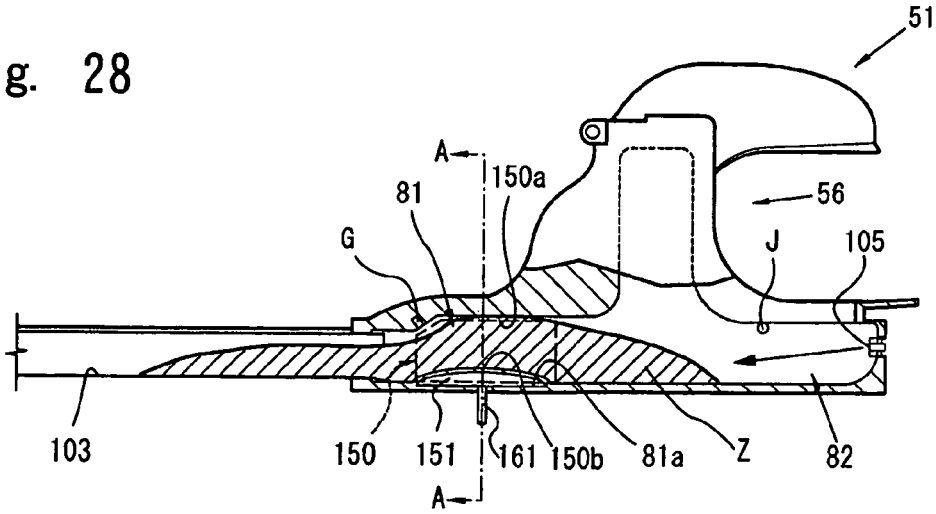
FIG. 28 is an explanatory view showing a treatment state of the urine and stools and washing water in the fecal and urinary treatment unit.
Figure 29:
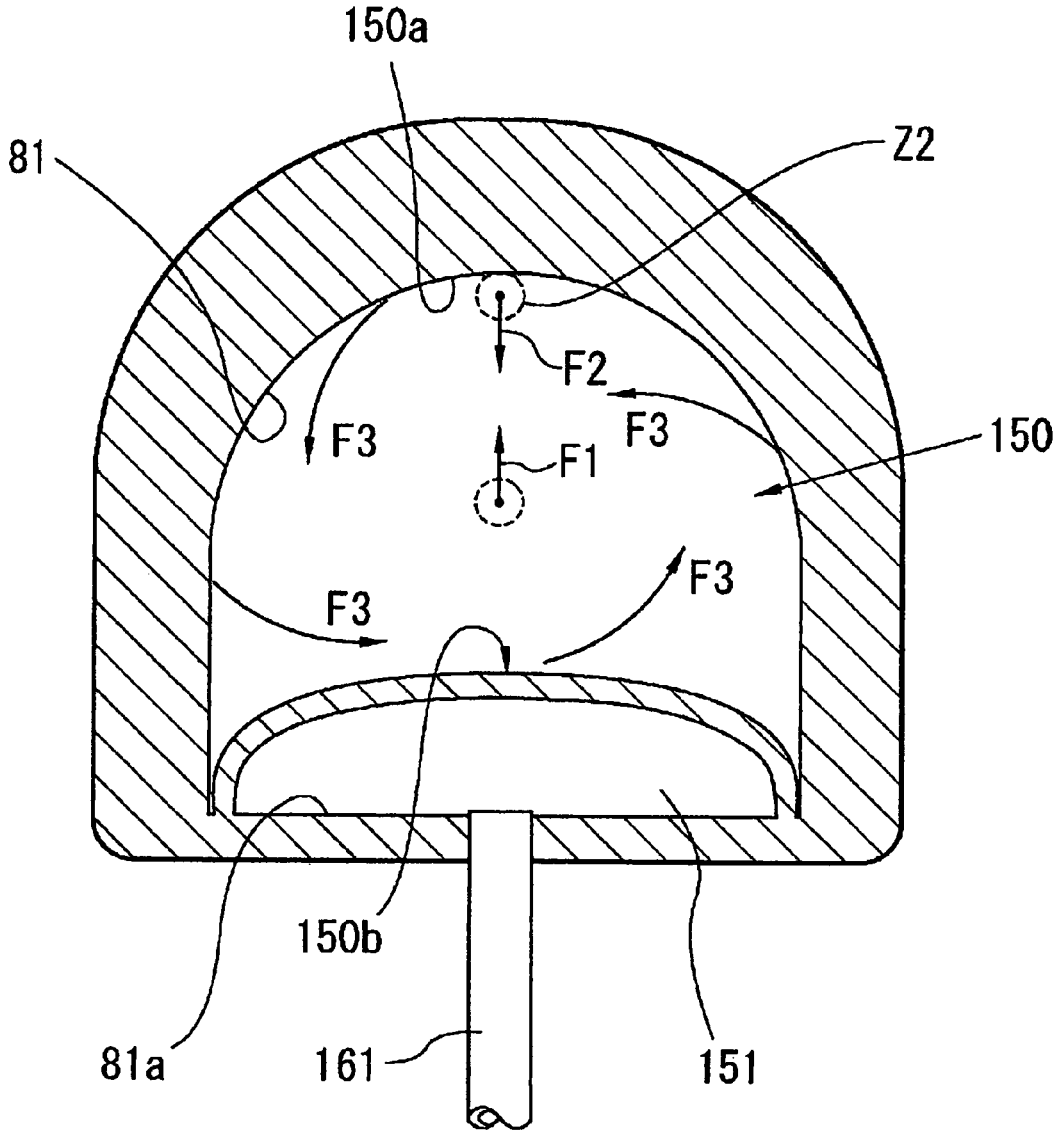
FIG. 29 is a cross-sectional view showing the fecal and urinary treatment unit taken along a line A-A in FIG. 28.
Figure 30:
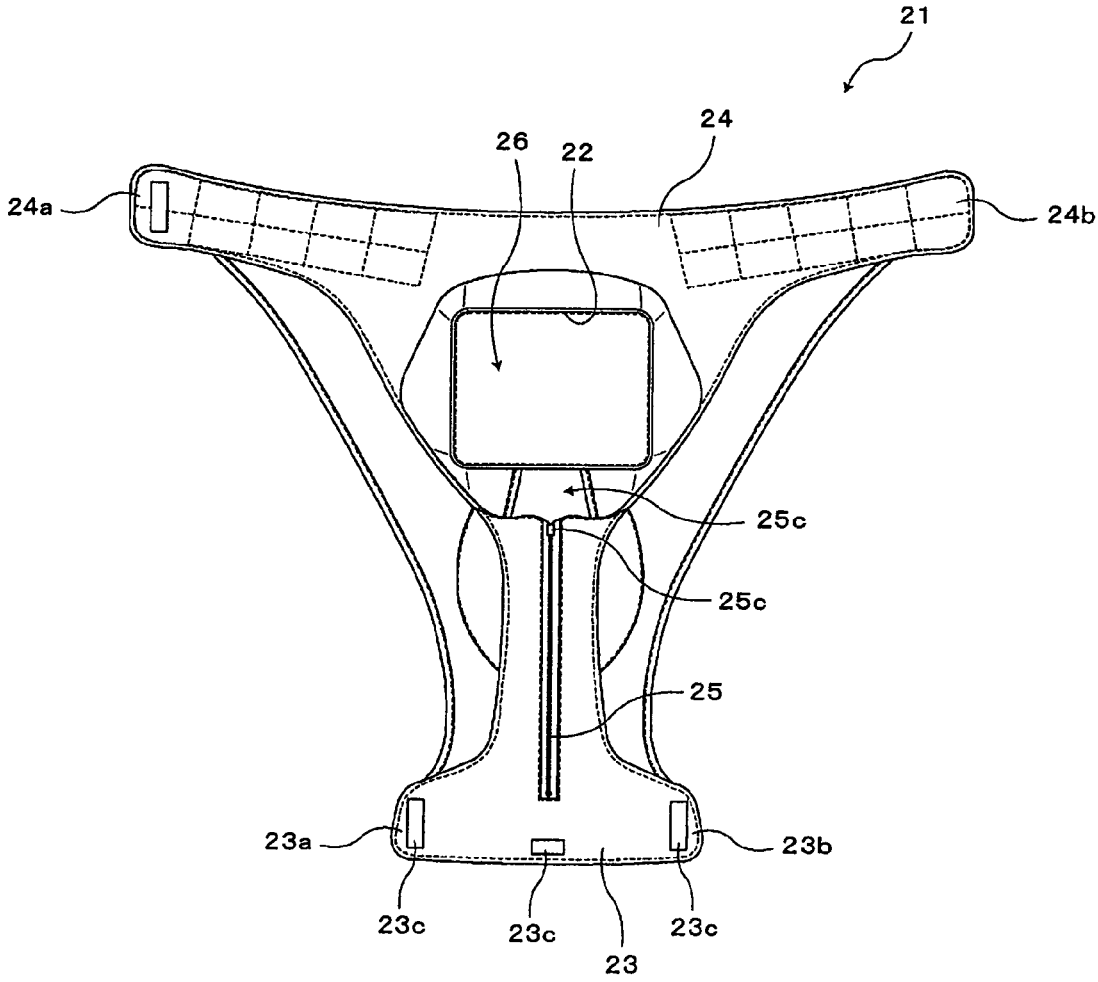
FIG. 30 is a plan view showing a diaper for the fecal and urinary treatment unit according to this embodiment.
Figure 31:
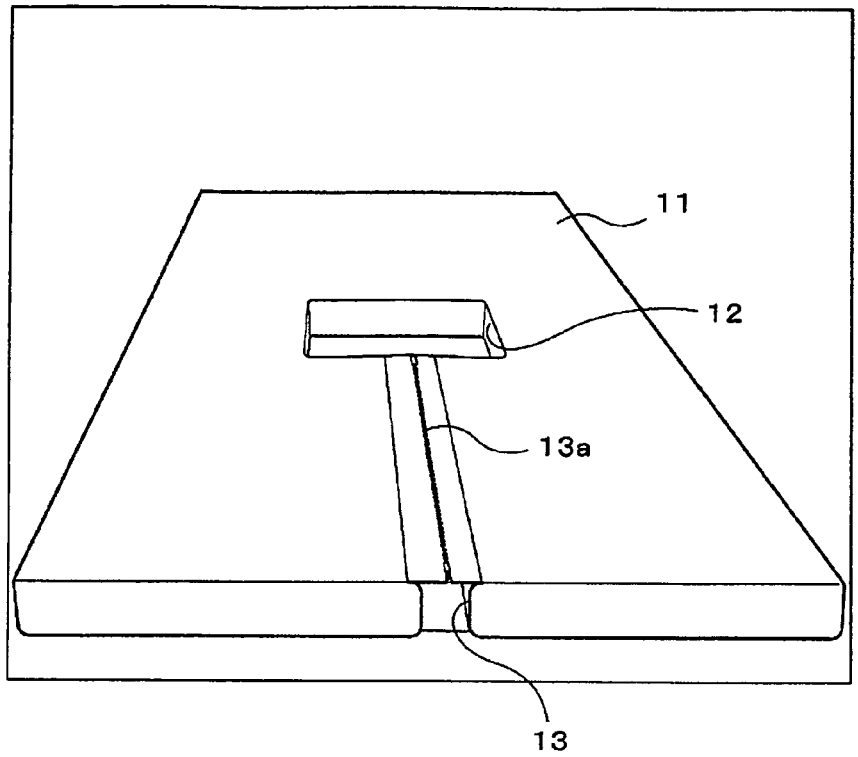
FIG. 31 is step view showing a mounting step of the automatic fecal and urinary treatment device using the diaper for the fecal and urinary treatment unit according to this embodiment.

The height of the air bag 151 is increased at the time of stopping the discharged urine and stools and washing water (see FIG. 26), while the height of the air bag 151 is lowered at the time of discharging urine and stools and washing water to the outside of the fecal and urinary treatment unit 51 as shown in FIG. 29 thus facilitating the flow of the discharged urine and stools and washing water Z in the discharge passage 81.

Timing at which the air bag 151 is shrunken so as to lower the height of the air bag 151 may take place at a point of time which comes after the discharged urine and stools and washing water in the discharge passage 81 are sucked, at a point of time that a water level sensor J detects a water level in the discharge passage 81, or at a point of time that a predetermined time elapses from the injection of washing water from the water injection nozzle 105 after detection of stools by a stool sensor G.

Further, the bent portion 150 may be formed from an upstream end to a downstream end of the discharge pipe 103 which is inserted into the pipe passage 13 of the mattress 11.

Next, in the above-mentioned automatic fecal and urinary treatment device using the diaper for the fecal and urinary treatment unit according to the present invention described above, the steps of mounting the treating device on the patient is explained in detail in conjunction with FIG. 30 to FIG. 40.

The mattress 11 is provided with the mounting hole 12 having a predetermined depth and the pipe passage 13 which is communicated with the mounting hole 12. An upper surface of the pipe passage 13 is openable or closable from an upstream end to a downstream end using a slide faster 13*a* (see FIG. 31).

Figure 32:
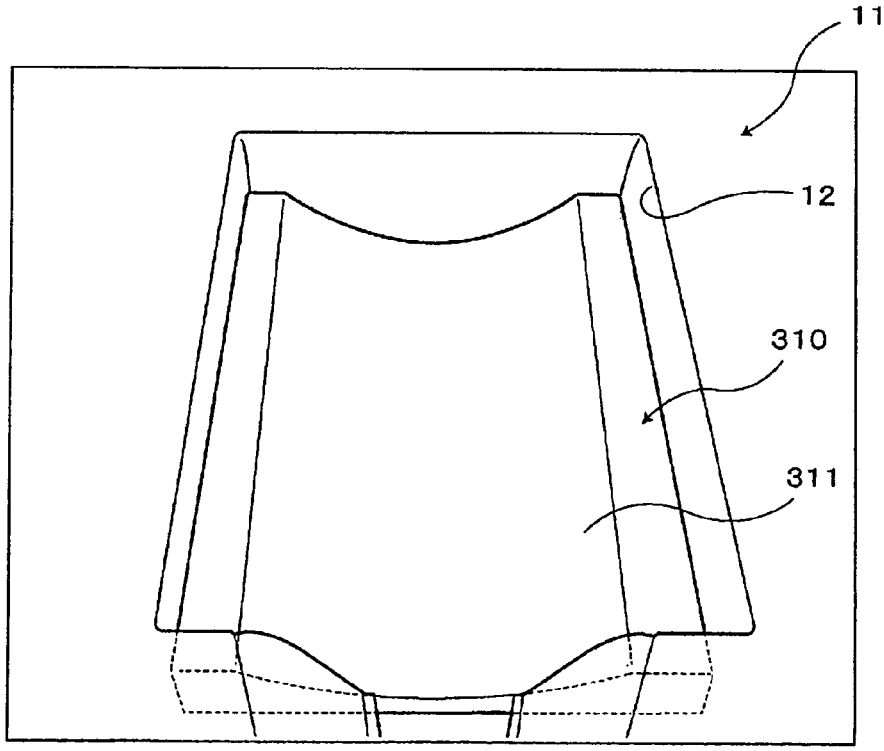
FIG. 32 is step view showing another mounting step of the automatic fecal and urinary treatment device using the diaper for the fecal and urinary treatment unit according to this embodiment.
Figure 33:
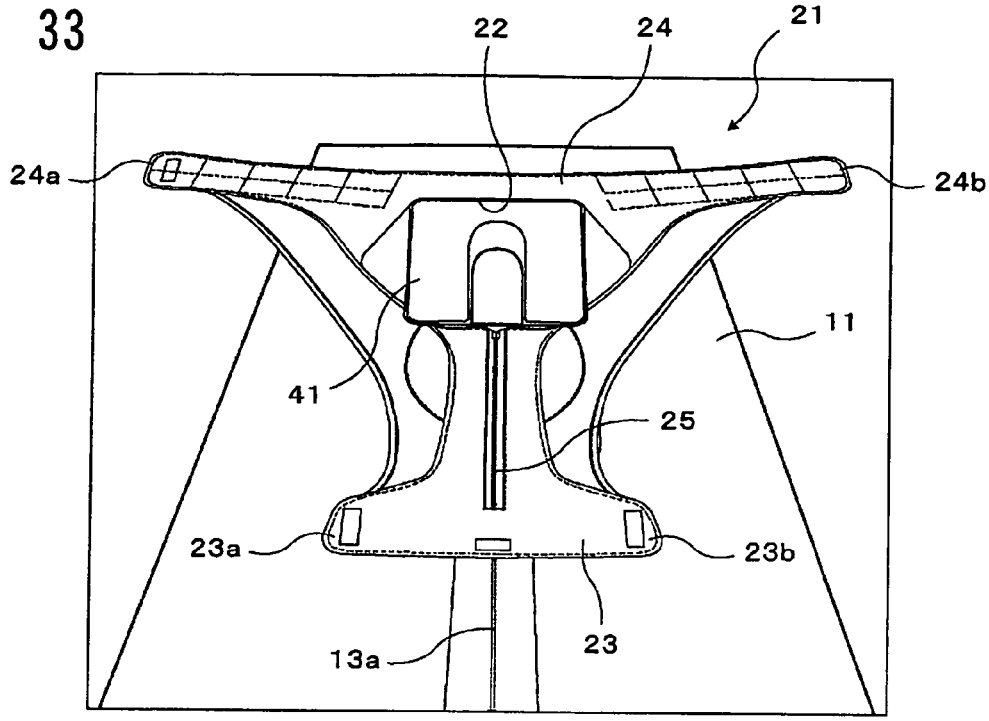
FIG. 33 is step view showing another mounting step of the automatic fecal and urinary treatment device using the diaper for the fecal and urinary treatment unit according to this embodiment.
Figure 34:
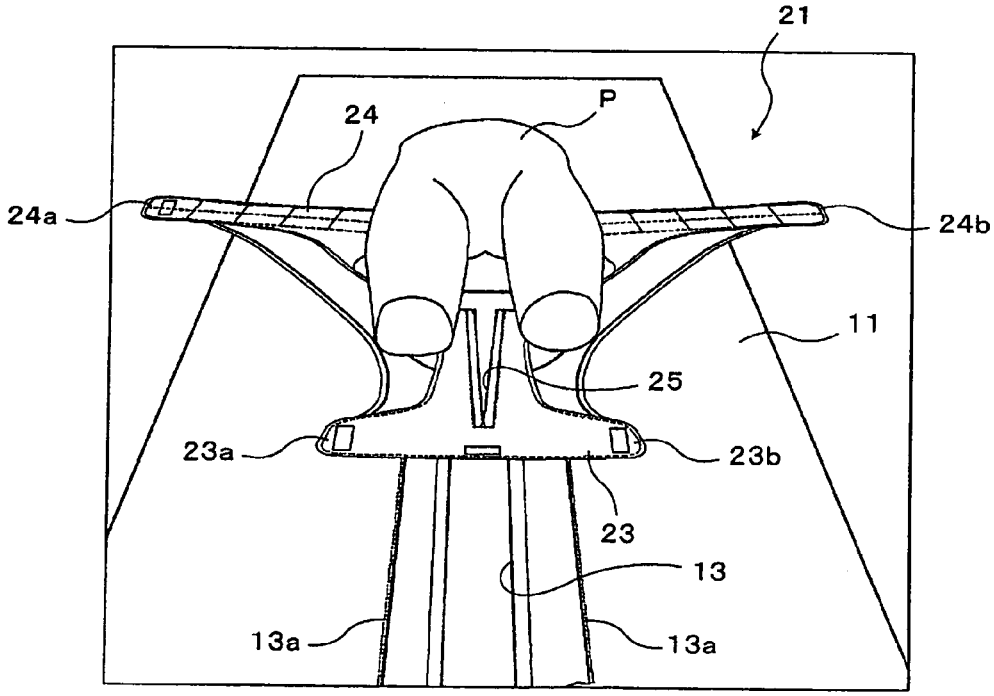
FIG. 34 is step view showing another mounting step of the automatic fecal and urinary treatment device using the diaper for the fecal and urinary treatment unit according to this embodiment.

Then, the pedestal 310 is placed in the inside of the mounting hole 12 formed in the mattress 11 in a state that the swing receiving surface 311 forms an upper surface (see FIG. 32).

Thereafter, the hole 22 formed at the center of the diaper 21 is mounted in the mounting hole 12 formed in the mattress 11 in a state that the waist wrapping portion 24 and the fold-over covering portion 23 are spread. Then, the buttock placing pad 41 is mounted in the hole 22 formed in the diaper 21 (see FIG. 30 and FIG. 33).

A patient P lies on the mattress 11 in a spine state. Here, buttocks of the patient are placed on the buttock placing pad 41, and the waist of the patient is positioned above the waist wrapping portion 24. At this time, the slide fastener 13*a* arranged on the pipe passage 13 of the mattress 11 is in an open state (see FIG. 34).

Figure 35:
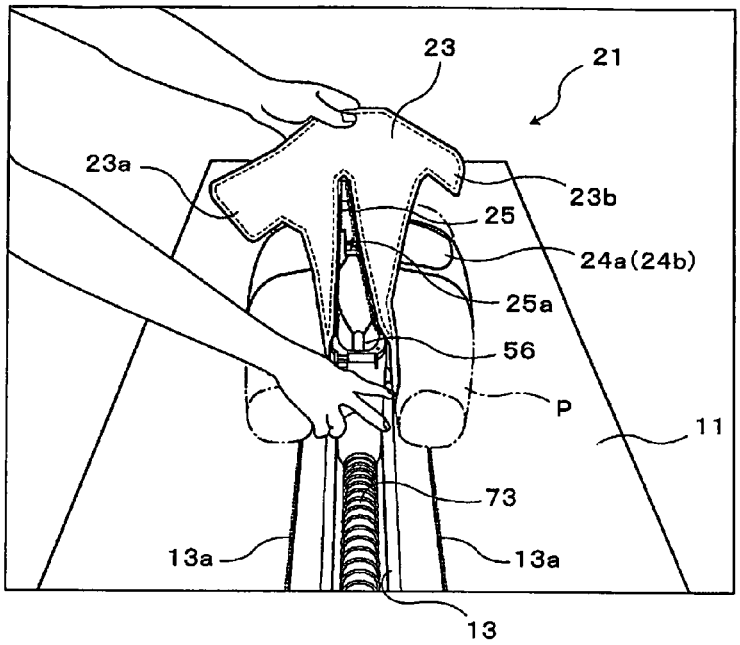
FIG. 35 is step view showing another mounting step of the automatic fecal and urinary treatment device using the diaper for the fecal and urinary treatment unit according to this embodiment.

Accordingly, as shown in FIG. 35, to mount the treating body 56 on the diaper 21, as described previously, the diaper 21 is opened laterally by opening the slide fastener 25 at the center of the diaper 21, the treating body 56 having an approximately L shape is inserted through the opening portion 25*a*, and is mounted on the pedestal 310 which is already placed in the hole 22 formed at the center of the diaper 21 by way of the support frame body 31.

Thereafter, the buttocks or the hips of the patient are placed on the treating body 56, and the treating body 56 having an approximately L shape is clamped by thighs of the patient. Then, upper edge portions 24*a*, 24*b* of the waist wrapping portion 24 at the upper end portion of the diaper 21 are closed from left and right sides, and are overlapped with each other on an abdominal portion of the patient thus bringing about a state where the diaper 21 is fixed by winding the upper edge portions 24*a*, 24*b* of the diaper 21 to a peripheral surface of the hips of the patient.

Figure 36:
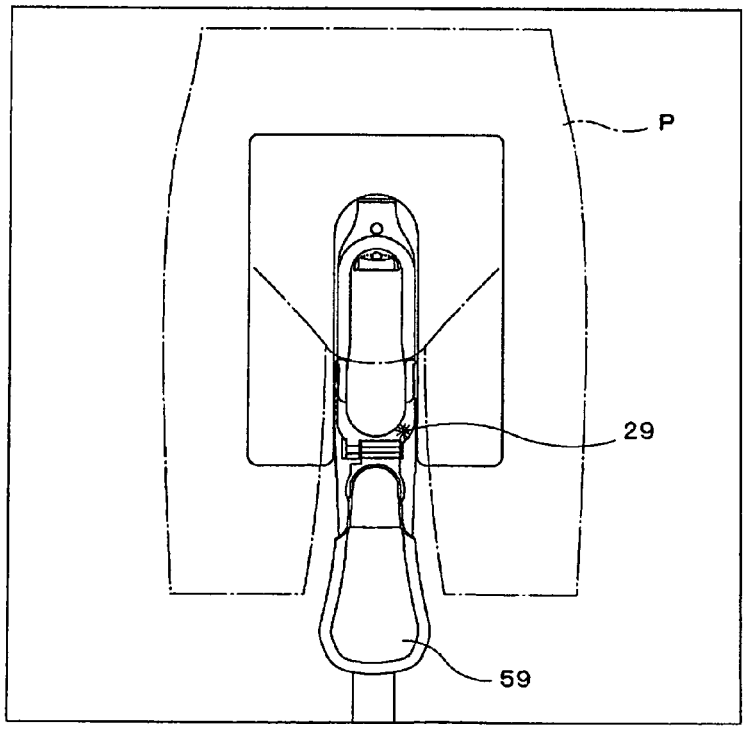
FIG. 36 is step view showing another mounting step of the automatic fecal and urinary treatment device using the diaper for the fecal and urinary treatment unit according to this embodiment.

As shown in FIG. 36, in mounting the treating body 56 on private parts of the patient, when a wearing sensor I of the treating body 56 detects a state where the treating body 56 is mounted on the private parts of the patient, an LED lamp 29 is turned on in response to a signal from the wearing sensor I. Since the LED lamp 29 is turned on, the accurate mounting of the treating body 56 on the private parts of the patient and a close mounting state of the treating body 56 on the private parts of the patient can be visually recognized. The cover body 59 can be closed after confirming the wearing state.

Next, the fold-over covering portion 23 which constitutes a lower end portion of the diaper 21 is folded. In such an operation, the fold-over covering portion 23 covers both side surfaces of the treating body 56 by making use of portions opened by the slide fastener 25. The cover body 59 provided to the treating body 56 is closed so as to cover the private parts of the patient from above. In such a state, both end portions 23*a*, 23*b* of the fold-over covering portion 23 of the diaper 21 are overlapped with the waist wrapping portion 24 which already wraps the hips of the patient, and are adhered to and fixed to the waist wrapping portion 24 by a predetermined stopper means 23*c*, for example, a magic band (registered trademark) or the like.

Figure 39:
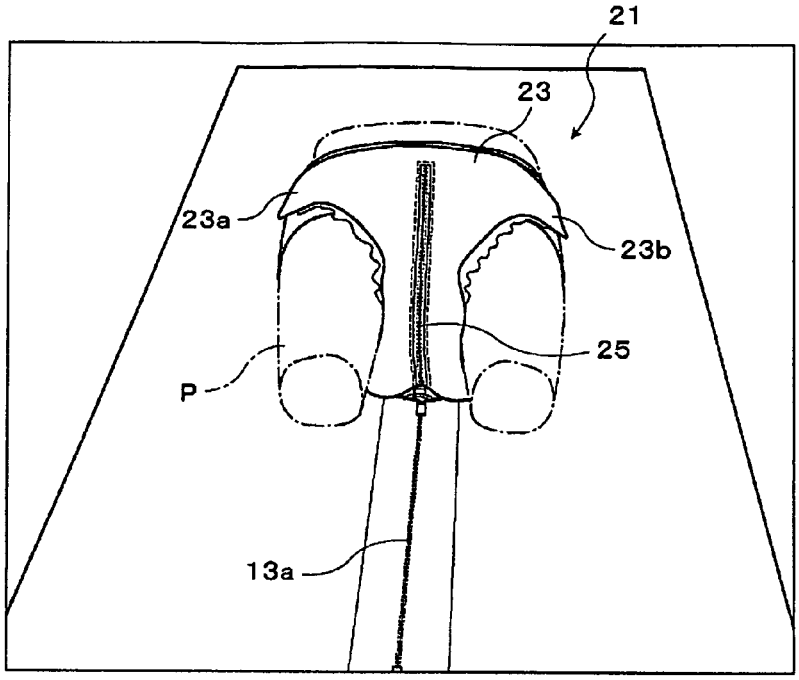
FIG. 39 is step view showing another mounting step of the automatic fecal and urinary treatment device using the diaper for the fecal and urinary treatment unit according to this embodiment.

When the slide faster 25 of the diaper 21 is closed in such a state, as shown in FIG. 39, the whole automatic fecal and urinary treatment device K is covered with the diaper 21 thus bringing about a state where the whole private parts of the patient and the whole treating body 56 mounted on the private parts are hermetically surrounded by the diaper 21 whereby spreading of a foul odor at the time of urination and defecation can be also prevented.

An open/close tab 25*b* is mounted on an upper end portion of the slide fastener 25 in a state where the diaper 21 is developed, and the slide fastener 25 is communicated with the hole 22 formed at the center portion and hence, the discharge pipe 103 which is communicated with the treating body 56 by way of the coupling 58 is inserted into the hole 22 by making use of an upstream-end opening portion 25*c* of the slide fastener 25 and is extended to the outside of the diaper 21.

Figure 37:
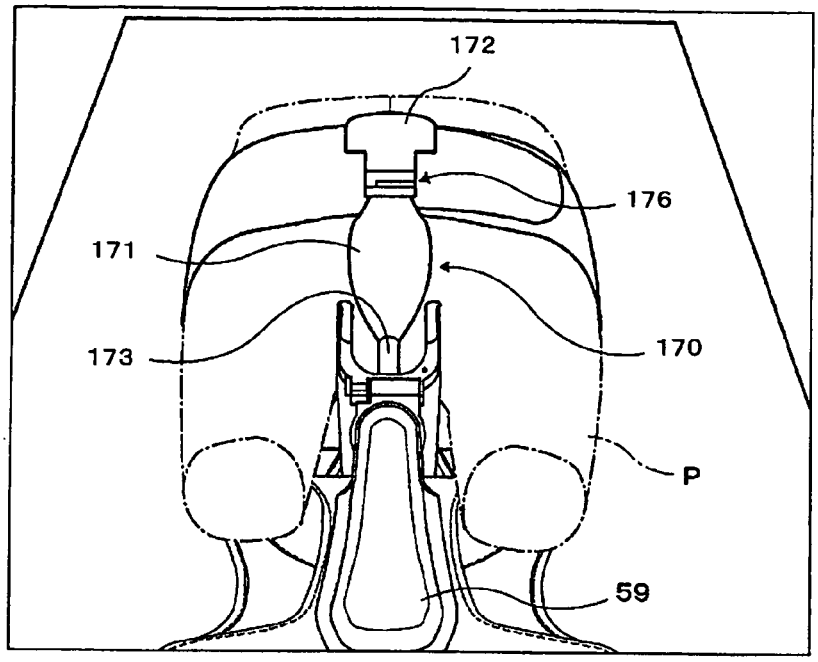
FIG. 37 is step view showing another mounting step of the automatic fecal and urinary treatment device using the diaper for the fecal and urinary treatment unit according to this embodiment.
Figure 38:
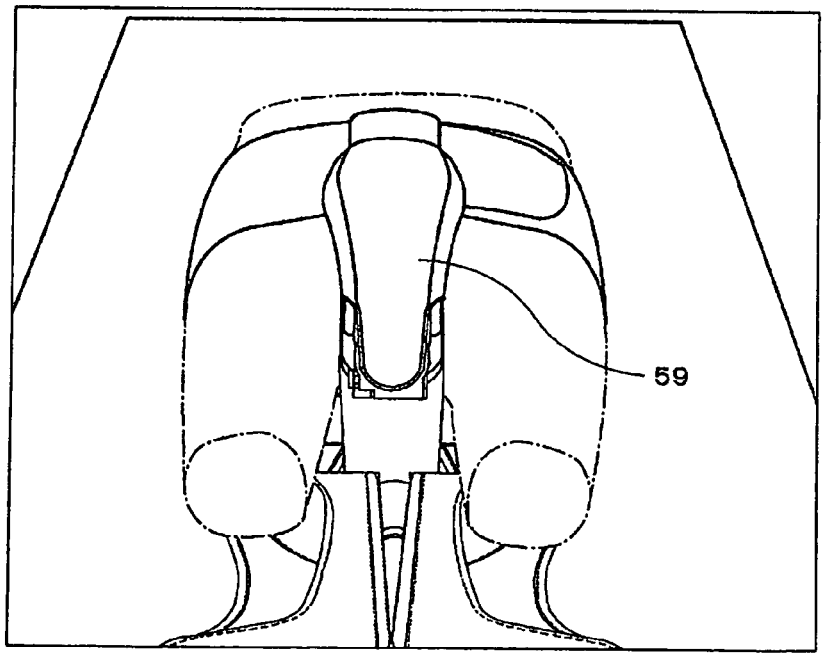
FIG. 38 is step view showing another mounting step of the automatic fecal and urinary treatment device using the diaper for the fecal and urinary treatment unit according to this embodiment.

As shown in FIG. 37 and FIG. 38, when a patient who wears the treating body 56 is a male patient, the treating body 56 is mounted on the patient, and the upper edge portions 24*a*, 24*b* of the diaper 21 are wound around and fixed to the peripheral surface of the hips of the patient. Thereafter, a urine collector 170 which is used by the male patient in urination is mounted on the patient, and a mounting portion 152 is mounted on the upper edge portions 24*a*, 24*b* on an abdominal portion of the patient P.

The urine collector 170 is constituted of a curved tubular urine collecting body 171, a planar mounting portion 152 which is mounted on a proximal end of the urine collecting body 171, and a urine collecting pipe 173 which is contiguously mounted on the distal end of the urine collecting body 171.

The urine collecting body 171 is constituted of a silicon-made bag and is constituted of private parts inserting portion having an obliquely opened proximal end and a urine collecting space portion formed in a curved cylindrical shape. The patient can urinate by inserting his private parts into the inside of the urine collecting space portion through the private parts inserting portion.

The mounting portion 172 is formed into a planar shape and is mounted on an upper edge portion of the proximal end of the urine collecting body 171 in a projecting manner. A rear surface of the mounting portion 172 is detachably adhered to a seam portion of a body portion of the diaper 21 for the patient using a tape or the like. A mounting position of the mounting portion 172 is arbitrary adjustable. A hinge portion 176 is interposed in a middle portion of the mounting portion 172 in a flexible or pivotable manner so that the mounting portion 172 is flexibly displaced corresponding to the vertical displacement of the urine collecting body 171 with respect to the mounting portion 172 thus allowing the urine collector 170 to fit on the private parts of the patient. That is, the mounting portion 172 and the urine collecting body 171 are flexibly constituted corresponding to a physical type of the patient. The urine collecting pipe 173 is a short pipe which is communicably connected with a distal end of the urine collecting body 171. The urine collecting pipe 173 can be manually guided in the pipe direction. That is, the urine collecting pipe 173 can be guided into the inside of the fecal and urinary treatment unit 51 thus facilitating the discharge of the urine.

After the urine collector 170 is mounted on the patient, the lid body 59 mounted on the treating body 56 is closed so as to cover the private parts of the patient from above. Both end portions 23*a*, 23*b* of the covering portion 23 are overlapped with the waist wrapping portion 24 which already wraps the hips of the patient in accordance with the above-mentioned steps, and both end portions 23*a*, 23*b* are fixed to the waist wrapping portion 24 by adhesion using a predetermined stopper means 23*c*, for example, a magic band (registered trademark) or the like, for example.

Figure 40:
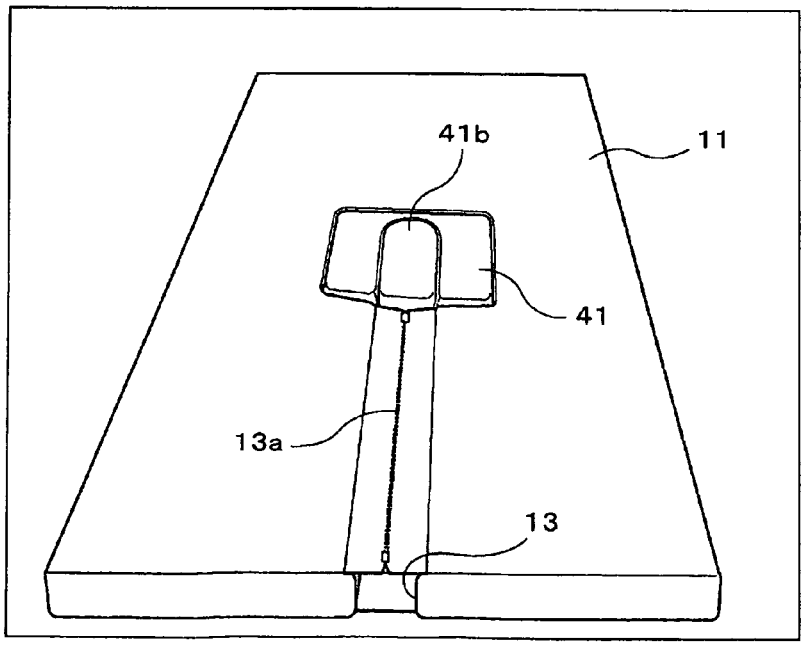
FIG. 40 is step view showing another mounting step of the automatic fecal and urinary treatment device using the diaper for the fecal and urinary treatment unit according to this embodiment.
Figure 41:
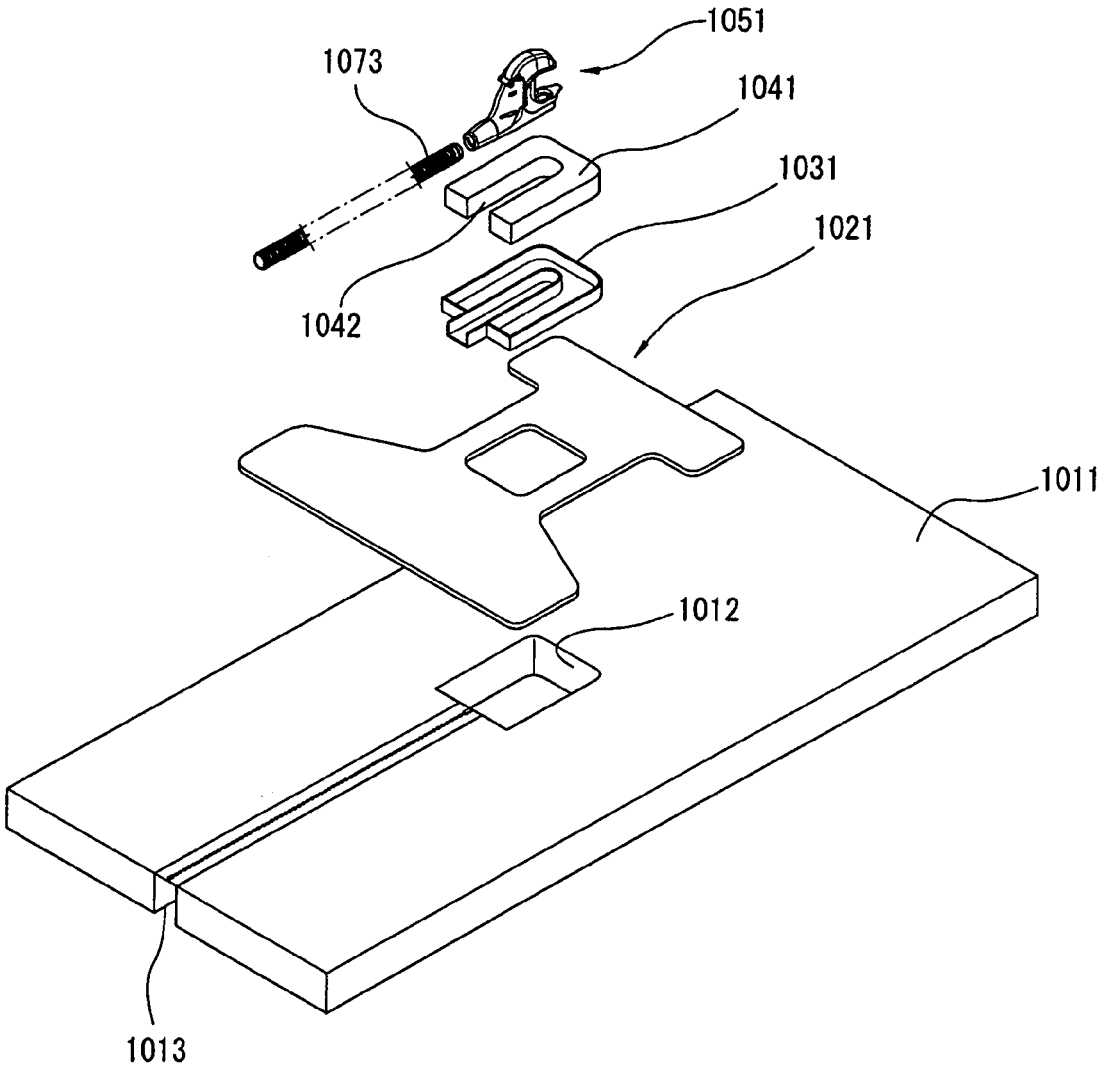
FIG. 41 is an exploded perspective view showing a conventional automatic fecal and urinary treatment device.

When the automatic fecal and urinary treatment device K is not used, the pedestal 310, the support frame body 31 and the buttock placing pad 41 are mounted in the mounting hole 12 formed in the mattress 11, and the rectangular pad 41*a* is mounted in the cutout space 41*a* formed in the buttock placing pad 41, the I-shaped pad (not shown in the drawing) is mounted in the pipe passage 13 thus using the mattress 11 also as a usual mattress (see FIG. 40).

It is to be noted that although some of the preferred embodiments of the present invention have been explained with reference to the drawings, these are provided merely for an exemplifying purpose and various modifications and improvements can be made without departing from the gist of the present invention.

What is claimed is:

1. An automatic fecal and urinary treatment device comprising:

a mattress which has an approximately rectangular mounting hole formed in an approximately center portion thereof;

a pedestal which has an upper surface of a concave arcuate shape and is configured to be fitted into the mounting hole;

a support frame body which is mounted on the pedestal and has an outer bottom surface of a convex arcuate shape which conforms with the upper surface of a concave arcuate shape so as to allow the lateral swinging of the support frame body on the pedestal;

a buttock placing pad which is mounted on an upper surface of the support frame body and forms a U-shaped cutout space in a center portion thereof; and a fecal and urinary treatment unit which is loosely fitted into the U-shaped cutout space formed in the buttock placing pad and is configured to perform washing of buttocks and private parts and discharging of urine and stools to the outside.

2. The automatic fecal and urinary treatment device according to claim 1, wherein an adjustment stopper means which restricts a swing range of the support frame body is formed on a distal edge portion of the upper surface of the pedestal having a concave arcuate shape.

3. The automatic fecal and urinary treatment device according to claim 1, wherein an insertion hole is formed in left and right portions of a front wall of the pedestal, left and right free ends of approximately mountain-shaped fixing jigs are allowed to be inserted into the insertion holes thus preventing the support frame body which is swingably mounted on the pedestal from being removed from the pedestal using a fixing jig when the support frame body is swung.

4. The automatic fecal and urinary treatment device according to claim 1, wherein an inner bottom surface of the support frame body is formed into a concave arcuate shape and an outer bottom surface of the buttock placing pad is formed into a convex arcuate shape, and the buttock placing pad is mounted on an upper surface of the support frame body in a close contact state.

5. The automatic fecal and urinary treatment device according to claim 1, wherein the fecal and urinary treatment unit has an approximately L shape and is constituted of a horizontal member which has the inside thereof formed into a boat shape and is configured to discharge urine and stools to the outside by making use of discharged water from a nozzle mounted on a bottom portion of the fecal and urinary treatment unit, and a vertical member which mounts a nozzle for drying with supply of air after washing buttocks and private parts on a front surface thereof, a distal end of the horizontal member of the fecal and urinary treatment unit is communicably connected with a storage tank by way of a discharge pipe, and various nozzles which are mounted on the horizontal member and the vertical member are communicably connected with a washing water supply portion by way of a nozzle operation portion which is configured to perform a water supply control and an air supply control.

6. The automatic fecal and urinary treatment device according to claim 1, wherein a detection means which detects a swing angle of the support frame body is mounted on the support frame body which is swingable on the pedestal, and washing of the buttocks and the private parts is stopped when the detection means detects a swing of equal to or more than a fixed angle.

7. The automatic fecal and urinary treatment device according to claim 6, wherein the detection means is a magnetic sensor which detects a swing angle by sensing a magnetic field of a magnet mounted on the pedestal.

8. The automatic fecal and urinary treatment device according to claim 1, wherein a pipe passage extending to an end portion of the mattress from the mounting hole is provided, the fecal and urinary treatment unit which is mounted in the mounting hole and a discharge pipe fitted into a pipe passage are communicated with each other, and urine and stools are conveyable to the outside of the mattress by the fecal and urinary treatment unit by way of a discharge pipe, and a bent portion is formed on a portion of a urination and defecation passage ranging from the inside of the fecal and urinary treatment unit to a downstream end of the discharge pipe thus generating a vortex flow at the time of conveying urine and stools.

9. The automatic fecal and urinary treatment device according to claim 1, wherein a diaper for the fecal and urinary treatment unit is mounted on a periphery of the mounting hole, and the diaper is constituted of: a waist wrapping portion which is an approximately triangular large-width upper end portion of the diaper and is stretchable laterally so as to cover hips of a patient; a central hole which is formed in a center portion of the diaper in a state where the hole is aligned with the mounting hole formed in the approximately center portion of the mattress; a fold-over covering portion which extends downward with a width thereof gradually narrowed from the central hole and is foldable toward the waist wrapping portion; and a slide fastener which is formed on an approximately center portion of the fold-over covering portion, is operable to be opened or closed in the lateral direction from the center of the fold-over covering portion, and has an upstream end thereof positioned at the central hole and has a downstream end thereof positioned at an intermediate portion of the fold-over covering portion.

* * * * *